US010862211B2

(12) United States Patent
Pu et al.

(10) Patent No.: US 10,862,211 B2
(45) Date of Patent: Dec. 8, 2020

(54) INTEGRATED ANTENNA STRUCTURE

(71) Applicant: HTC Corporation, Taoyuan (TW)

(72) Inventors: Ta-Chun Pu, Taoyuan (TW); Chien-Ting Ho, Taoyuan (TW); Yen-Liang Kuo, Taoyuan (TW)

(73) Assignee: HTC Corporation, Taoyuan (TW)

( * ) Notice: Subject to any disclaimer, the term of this patent is extended or adjusted under 35 U.S.C. 154(b) by 4 days.

(21) Appl. No.: 16/106,021

(22) Filed: Aug. 21, 2018

(65) Prior Publication Data

US 2020/0067188 A1 Feb. 27, 2020

(51) Int. Cl.

| | |
|---|---|
| ***H01Q 19/06*** | (2006.01) |
| ***H01Q 3/44*** | (2006.01) |
| ***H01Q 1/38*** | (2006.01) |
| ***H01Q 9/06*** | (2006.01) |
| ***H01Q 19/18*** | (2006.01) |

(52) U.S. Cl.

CPC ..... *H01Q 3/44* (2013.01); *H01Q 1/38* (2013.01); *H01Q 9/065* (2013.01); *H01Q 19/18* (2013.01)

(58) Field of Classification Search

CPC ..... H01Q 3/44; H01Q 9/065; H01Q 19/18; H01Q 1/38

See application file for complete search history.

(56) References Cited

U.S. PATENT DOCUMENTS

| | | | | |
|---|---|---|---|---|
| 8,519,890 | B2 | 8/2013 | Huang et al. | |
| 2013/0257672 | A1 | 10/2013 | Lu et al. | |
| 2013/0273858 | A1 | 10/2013 | Sover et al. | |
| 2016/0087348 | A1* | 3/2016 | Ko | H01Q 21/245 455/73 |
| 2017/0222333 | A1* | 8/2017 | Sudo | H01Q 1/38 |
| 2018/0048075 | A1 | 2/2018 | Park et al. | |
| 2019/0288377 | A1* | 9/2019 | Ying | H01Q 9/0457 |

FOREIGN PATENT DOCUMENTS

| | | | |
|---|---|---|---|
| CN | 201570586 | U | 9/2010 |
| CN | 102110882 | A | 6/2011 |
| CN | 1815806 | B | 5/2012 |
| CN | 103606757 | A | 2/2014 |
| CN | 103797644 | A | 5/2014 |
| CN | 105449345 | A | 3/2016 |
| CN | 205646141 | U | 10/2016 |
| CN | 106159464 | A | 11/2016 |
| CN | 107078403 | A | 8/2017 |
| CN | 107275767 | A | 10/2017 |

(Continued)

OTHER PUBLICATIONS

Corresponding extended European search report dated Jun. 19, 2019.

(Continued)

*Primary Examiner* — Dieu Hien T Duong

(74) *Attorney, Agent, or Firm* — CKC & Partners Co., LLC

(57) ABSTRACT

An integrated antenna structure is provided, which includes a substrate and a dual-polarized antenna unit disposed in the substrate and near a side edge of the substrate. The dual-polarized antenna unit includes a horizontally polarized antenna configured to generate a horizontally polarized beam and a vertically polarized antenna configured to generate a vertically polarized beam.

20 Claims, 30 Drawing Sheets

(56) References Cited

FOREIGN PATENT DOCUMENTS

| | | | |
|---|---|---|---|
| CN | 107946765 | A | 4/2018 |
| EP | 1814195 | A1 | 8/2007 |
| EP | 1876672 | A1 | 1/2008 |
| TW | I378601 | B | 12/2012 |
| WO | 2018095535 | A1 | 5/2018 |

OTHER PUBLICATIONS

Corresponding Taiwan office action dated Dec. 6, 2019.
Yang Cai et al., "Bandwidth Enhancement of SIW Horn Antenna Loaded With Air-Via Perforated Dielectric Slab", IEEE Antennas and Wireless Propagation Letters, vol. 13, 20 Mar. 2014, pp. 571-574.
Corresponding Chinese office action dated Sep. 18, 2020.

* cited by examiner

234'''

INTEGRATED ANTENNA STRUCTURE

BACKGROUND

Technical Field

The invention relates to an antenna structure, and more particularly to an integrated antenna structure.

Description of Related Art

With the vigorous development of communication technologies, commercial mobile communication systems can achieve high-speed data transmission, and provide Internet service providers with a wide range of services, such as network services of multimedia video streaming, instant road reporting and navigation, and instant network communication that require huge data transmission quantity. For hardware, an antenna design affects the performance of the wireless signals transmitting and receiving. Therefore, how to design a high-performance antenna is one of the goals in the related industries.

SUMMARY

The objective of the invention is to provide an integrated antenna structure in which dual-polarized antenna units are disposed at edges of a substrate for generating dual-polarized radiation patterns, so as to increase the performance of antennas for transmission and reception.

One aspect of the invention relates to an integrated antenna structure which includes a substrate and a dual-polarized antenna unit. The dual-polarized antenna unit is disposed in the substrate and near a side edge of the substrate. The dual-polarized antenna unit includes a horizontally polarized antenna and a vertically polarized antenna. A polarized direction of the horizontally polarized antenna is perpendicular to a thickness direction of the substrate, and a polarized direction of the vertically polarized antenna is perpendicular to the thickness direction of the substrate.

Another aspect of the invention relates to an integrated antenna structure which includes a substrate and a plurality of antenna units. The antenna units are disposed in the substrate and near at least one side edge of the substrate. The antenna units are spaced from each other. Each of the antenna units includes a horizontally polarized antenna and a vertically polarized antenna. A polarized direction of the horizontally polarized antenna is perpendicular to a thickness direction of the substrate, and a polarized direction of the vertically polarized antenna is perpendicular to the thickness direction of the substrate.

Another aspect of the invention relates to an integrated antenna structure which includes a substrate, a first antenna unit and second antenna units. The first antenna unit is disposed in a center area of the substrate. The second antenna units are disposed in the substrate and near at least one side edge of the substrate. The antenna units are spaced from each other and laterally surround the first antenna unit.

BRIEF DESCRIPTION OF THE DRAWINGS

Embodiments and advantages thereof can be more fully understood by reading the following description with reference made to the accompanying drawings as follows.

DETAILED DESCRIPTION

The spirit of the disclosure is clearly described hereinafter accompanying with the drawings and detailed descriptions. After realizing preferred embodiments of the disclosure, any persons having ordinary skill in the art may make various modifications and changes according to the techniques taught in the disclosure without departing from the spirit and scope of the disclosure.

Further, spatially relative terms, such as "over," "on," "under," "below," and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 1A:
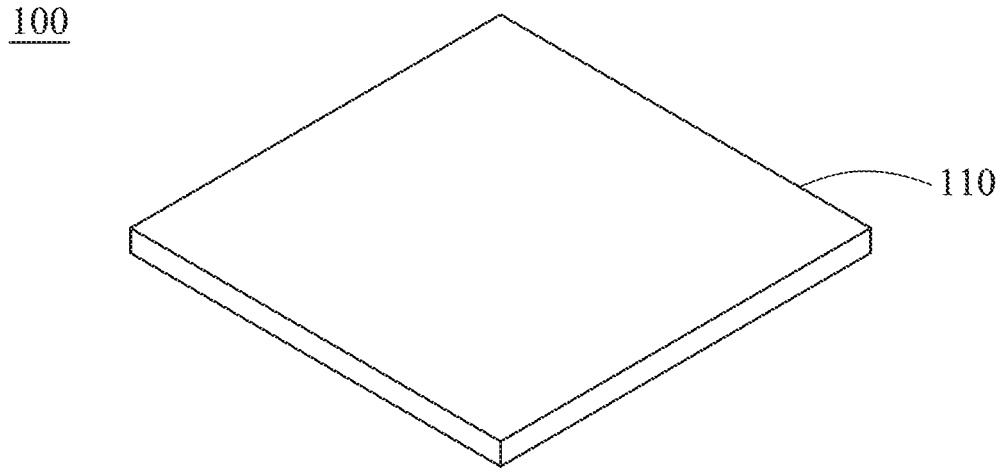
FIG. 1A and FIG. 1B are respectively a perspective view and a top-view of an integrated antenna structure in accordance with some embodiments of the invention.
Figure 1B:
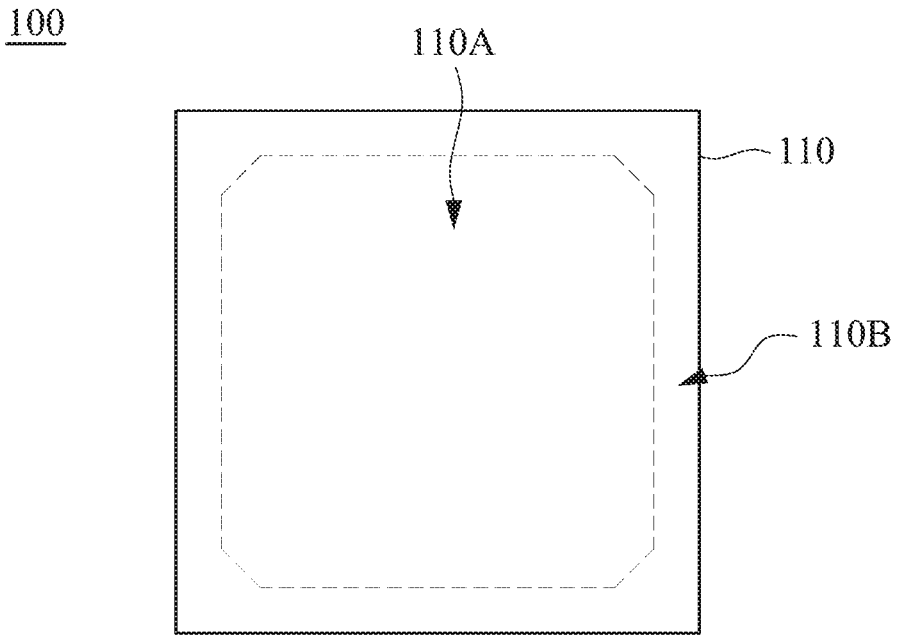

Referring to FIG. 1A and FIG. 1B, FIG. 1A and FIG. 1B are respectively a perspective view and a top-view of an integrated antenna structure 100. The integrated antenna structure 100 include at least a substrate 110 and components disposed on or in the substrate 110, such as radiation elements, conductive lines, switches and/or other components. The substrate 110 has a center area 110A and a peripheral area 110B that includes peripheral areas 110B, which will be described as various embodiments in the following paragraphs.

Figure 2:
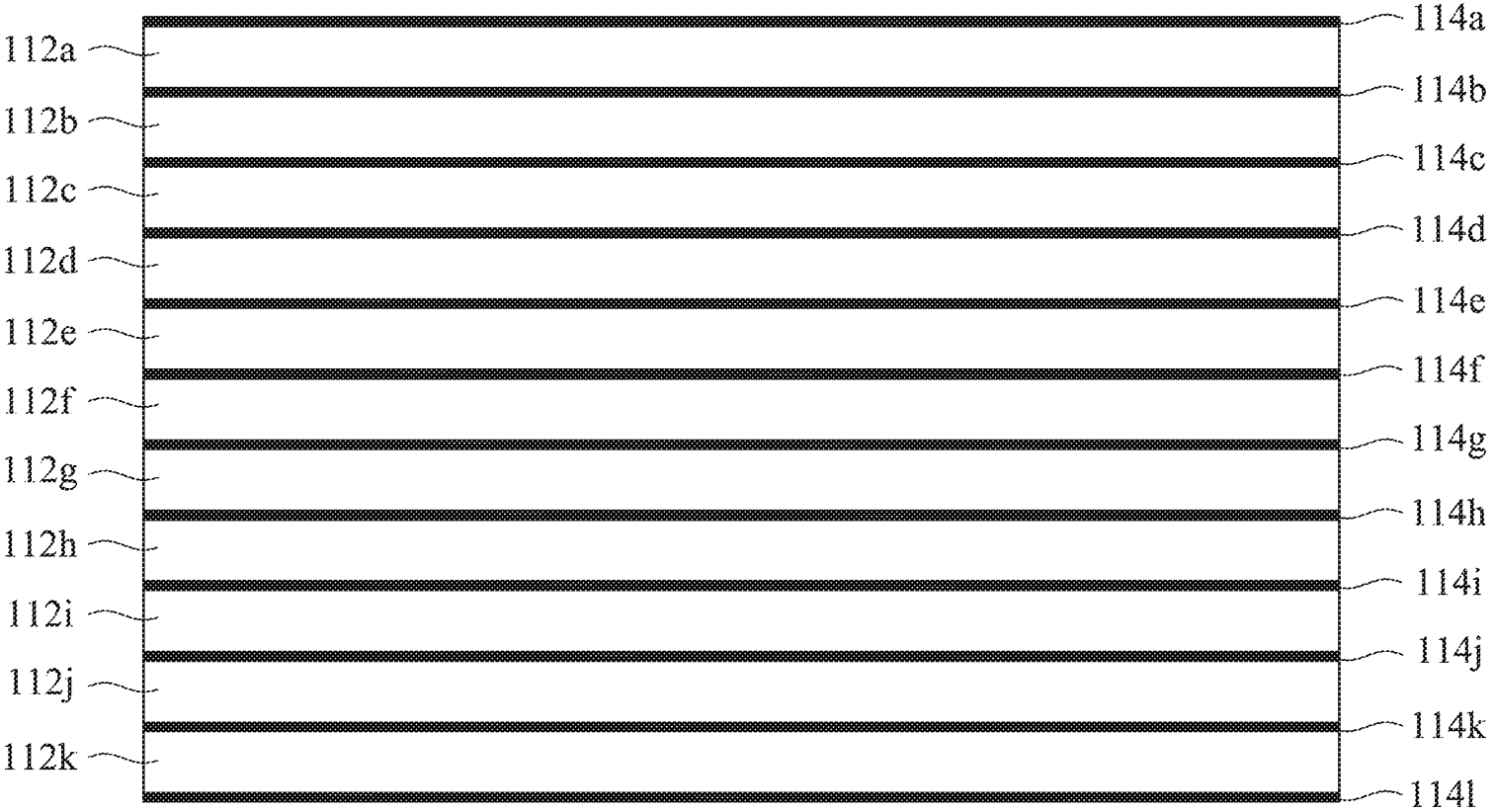
FIG. 2 is a cross sectional view of the integrated antenna structure in FIG. 1A.

FIG. 2 is a cross sectional view of the integrated antenna structure 100 in FIG. 1A. As shown in FIG. 1B, the substrate 110 is a multi-layered board structure formed of alternately stacked dielectric layers 112*a*-112*k* and metal layers 114*a*-114*l*. The dielectric layers 112*a*-112*k* may be formed from FR4 material, glass, ceramic, epoxy resin or silicon. The metal layers 114*a*-114*l* are respectively over the uppermost dielectric layer 112*a*, between adjacent two of the dielectric layers 112*a*-112*k* and under the lowermost dielectric layer 112*k*. The metal layers 114*a*-114*l* may be formed form copper, aluminum, nickel and/or another metal. Each of the metal layers 114*a*-114*l* may include a radiator element, a conductive line, a switch or another component needed to form an antenna structure. The metal layers 114*a*-114*l* may include different patterns based on the components formed in the metal layers 114*a*-114*l*. In addition, based on the material type of the dielectric layers 112*a*-112*k*, the substrate 110 may be formed by various processes, such as low-temperature cofired ceramic (LTCC), integrated passive device (IPD), multi-layered film, multi-layered printed circuit board (PCB) or another multi-layered process.

Figure 3:
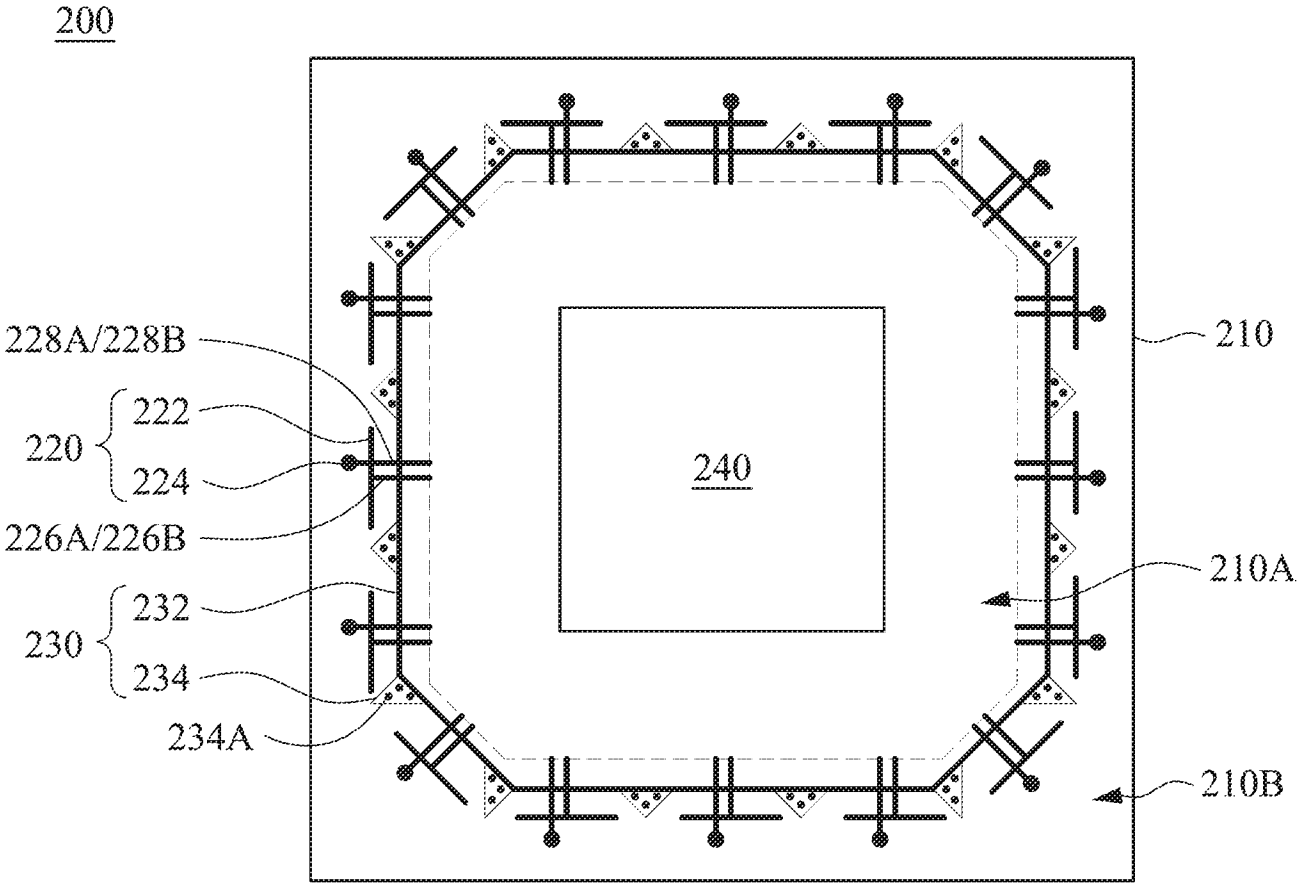
FIG. 3 is a schematic arrangement diagram of an integrated antenna structure in accordance with some embodiments of the invention.

FIG. 3 is a schematic arrangement diagram of an integrated antenna structure 200 in accordance with some embodiments of the invention. The integrated antenna structure 200 includes a substrate 210, dual-polarized antenna units 220, a reflective structure 230 and a chip 240.

As shown in FIG. 3, the substrate 210 has a center area 210A and a peripheral area 210B. The substrate 210 may be a multi-layered structure, which has a structure of alternately stacked dielectric layers and metal layers as illustrated in FIG. 2.

The dual-polarized antenna units 220 are mainly disposed in the peripheral area 210B of the substrate 210. The dual-polarized antenna units 220 include horizontally polarized antennas 222 and vertically polarized antennas 224. The horizontally polarized antennas 222 are configured to generate horizontally polarized beams, and the vertically polarized antennas 224 are configured to generate vertically polarized beams. The gains, the widths and the half-power beam widths (HPBW) of the respectively generated horizontally polarized beams and vertically polarized beams of the antenna units 220 are related to the types of the shapes of the horizontally polarized antennas 222 and the vertically polarized antenna 224*s*. The horizontally polarized antennas 222 and the vertically polarized antennas 224 are electrically coupled to the components in the center area 210A of the substrate 210 respectively through feeding traces 226A/226B, 228A/228B. The horizontally polarized antennas 222 may be in one of the metal layers, and the vertically polarized antennas 224 may be vertically across multiple dielectric layers. In addition, the feeding traces 226A/226B, 228A/228B may also be in one or more of the metal layers. Various embodiments of the horizontally polarized antennas 222 and the vertically polarized antennas 224 will be described in the following paragraphs.

The reflective structure 230 is primarily used to increase the directivity of the antenna units 220 and to block radiation waves from interfering the components in the center area 210A. The reflective structure 230 includes a reflective wall 232 and reflective substructure areas 234 each consisting of reflective substructures 234A. The reflective wall 232 and the reflective substructures 234A may be vertically across multiple dielectric layers. In addition, the reflective wall 232 and the reflective substructures 234A may be formed from copper, aluminum, nickel and/or another metal.

The chip 240 has a radio frequency integrated circuit (RFIC) and/or other active and/or passive components for constituting a transmitting and/or receiving circuit. The chip 240 may be bonded to the substrate 210 by such as ball grid array (BGA) packaging, chip scale packaging (CSP), filp chip packaging, wafer-level packaging or another suitable packaging method, such that the components in the chip 240 and in and/or on the substrate 210 are electrically connected with each other. In another embodiment, the integrated antenna structure 200 may include only the substrate 210, the dual-polarized antenna units 220 and the reflective structure 230 and may not include the chip 240.

It is noted that the number and the arrangements of the dual-polarized antenna units 220 may be correspondingly adjusted according to application requirements and may not be limited to the content shown in FIG. 3. The embodiment shown in FIG. 3 has 16 dual-polarized antenna units, four of the dual-polarized antenna units 220 are respectively disposed at the four corners of the substrate 210, while the others of the dual-polarized antenna units 220 are equally disposed at four side edges of the substrate 210. In another embodiment, according to some application requirements, the dual-polarized antenna units 220 may be disposed only at the four corners, four side edges or alternatively some corners and/or side edges of the substrate 210, and the number of the dual-polarized antenna units 220 may be correspondingly adjusted. For example, the integrated antenna structure 200 may include only four dual-polarized antenna units 220 respectively disposed at four side edges of the substrate 210. In addition, the shape of the substrate 210 and the ranges of the center area 210A and the peripheral area 210B thereof may also be correspondingly modified according to designs. For example, the shape of the substrate 210 may be modified to be an octagon, a circle or another shape according to designs. In another embodiment of the invention, the number and the arrangements of the dual-polarized antenna units may be correspondingly adjusted according to the above description.

Figure 4:
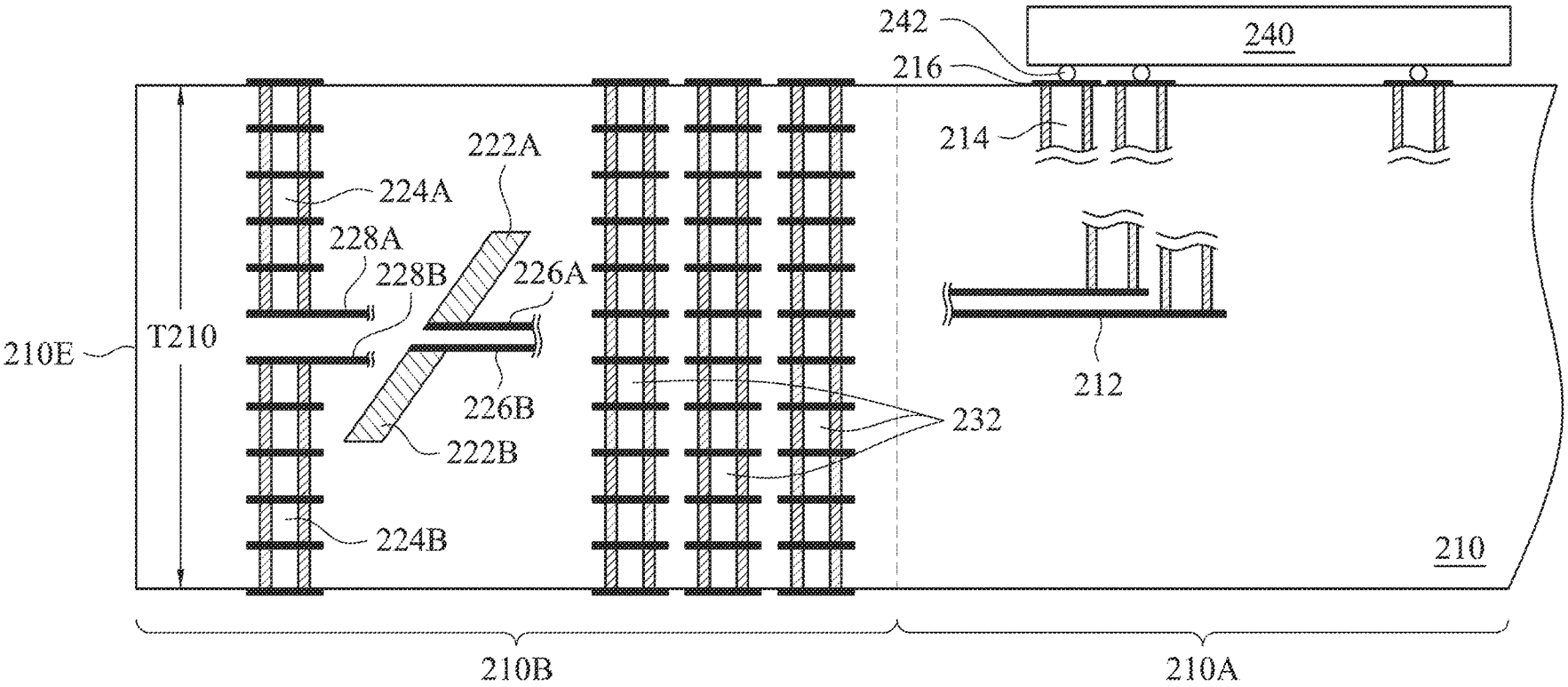
FIG. 4 is a partial structural diagram of the integrated antenna structure in FIG. 3.

FIG. 4 is a partial structural diagram of the integrated antenna structure 200 in FIG. 3. In the partial structural diagram shown in FIG. 4, a dual-polarized antenna unit 220 (which includes a horizontally polarized antenna 222 and a vertically polarized antenna 224) is disposed in the peripheral area 210B of the substrate 210, in which the vertically polarized antenna 224 is nearer to the side edge 210E of the substrate 210 than the horizontally polarized antenna 222. The reflective wall 232 is disposed between the dual-polarized antenna unit 220 and the center area 210A of the substrate 210, and the chip 240 is disposed on the substrate 210 and in the center area 210A of the substrate 210. In another embodiment, the horizontally polarized antenna 222 is nearer to the side edge 210E of the substrate 210 than the vertically polarized antenna 224, or alternatively the distance between the horizontally polarized antenna 222 and the side edge 210E of the substrate 210 is approximately the distance between the vertically polarized antenna 224 and the side edge 210E of the substrate 210.

As shown in FIG. 4, the horizontally polarized antenna 222 is a microstrip dipole antenna. The horizontally polarized antenna 222 includes two dipole arms 222A, 222B respectively coupled to the feeding traces 226A, 226B. The feeding traces 226A, 226B may penetrate through the reflective wall 232 to electrically couple to the components in the center area 210A, such that the dipole arms 222A, 222B are respectively electrically connected to the conductive lines 212, the conductive via structures 214 and/or the other components in the center area 210A. The vertically polarized antenna 224 includes conductive via structures 224A, 224B respectively electrically coupled to the feeding traces 228A, 228B. The feeding traces 228A, 228B may penetrate through the reflective wall 232 to respectively electrically couple to the components in the center area 210A, such that the conductive via structures 224A, 224B are respectively electrically coupled to the conductive lines 212, the conductive via structures 214 and/or the other components in the center area 210A. The dipole arms 222A, 222B and the feeding trace 226A, 226B, 228A, 228B may be in the same one or respectively in two or more of the metal layers in the substrate 210, and each of the feeding traces 226A, 226B, 228A, 228B may be electrically connected to conductive lines or other components in different layers through the conductive via structures which penetrate through the dielectric layers, in which the reflective wall and the conductive via structures may be formed of through substrate via (TSV) conductors. In practice, the conductive via structures may be conductive by coating conductive liquid/paint or plating conductive metal in the fabricating process. For example, the reflective wall is formed of multiple conductive via structure with conductivity, making its effectiveness like a reflector. Oppositely, the conductive via structures may not coat or plate any conductive material, and structurally only air exists in the via holes as dielectric material. In other words, the dielectric constant of the non-conductive via structure is different from the dielectric constant of the substrate, and therefore the non-conductive via structure has the same effect as a dielectric lens. Related embodiments and structure characteristics are further described in detail as follows.

The resonant frequencies of the horizontally polarized antenna 222 and the vertically polarized antenna 224 are dependent from the lengths of the dipole arms 222A, 222B and the conductive via structures 224A, 224B. Academically, the length of the horizontally polarized antenna 222 in the horizontally polarized direction and the length of the vertically polarized antenna 224 in the vertically polarized direction, may be evaluated from the following equations, and are approximately a half of the equivalent wavelength of the electromagnetic wave in the substrate 210 in practice. Academically, the relationship between the equivalent wavelength $\lambda_{210}$ of the electromagnetic wave in the substrate 210 and the equivalent wavelength $\lambda_0$ of the electromagnetic wave is as the following equation:

$$\lambda_{210} = \frac{\lambda_0}{\sqrt{\varepsilon_{210}}},$$

where $\varepsilon_{210}$ is the relative dielectric constant of the substrate 210. That is, the equivalent wavelength of the electromagnetic wave in the air is approximately $\sqrt{\varepsilon_{210}}$ times of the equivalent wavelength of the electromagnetic wave in the substrate 21. Therefore, the length $L_{222}$ of the horizontally polarized antenna 222 in the horizontally polarized direction may be approximately:

$$L_{222} = \frac{c_0}{2f_{222}\sqrt{\varepsilon_{210}}}, \tag{1}$$

where $c_0$ is the velocity of the electromagnetic wave in the air, and $f_{222}$ is the resonant frequency of the horizontally polarized antenna 222. The length $L_{224}$ of the vertically polarized antenna 224 in the vertically polarized direction may be approximately:

$$L_{224} = \frac{c_0}{2f_{224}\sqrt{\varepsilon_{210}}}, \tag{2}$$

where $f_{224}$ is the resonant frequency of the vertically polarized antenna 224. As can be seen from above, the length of the horizontally polarized antenna 222 in the horizontally polarized direction and the length of the vertically polarized antenna 224 in the vertically polarized direction may be dependent from the resonant frequencies thereof and the relative dielectric constant of the substrate 210. As can be seen from above, the length $L_{222}$ of the horizontally polarized antenna 222 in the horizontally polarized direction may be determined according to the resonant frequency $f_{222}$ of the horizontally polarized antenna 222 and the relative dielectric constant $\varepsilon_{210}$ of the substrate 210, and the length $L_{224}$ of the vertically polarized antenna 224 in the vertically polarized direction may be determined according to the resonant frequency $f_{224}$ of the vertically polarized antenna 224 and the relative dielectric constant $\varepsilon_{210}$ of the substrate 210. For the same reason, if the disposed positions of the horizontally polarized antenna 222 and the vertically polarized antenna 224 are near a surface of the substrate 210, an evaluation can be performed according to the contents and principles taught by the aforementioned equations as well.

The length of each of the dipole arms 222A, 222B may be approximately the same as or less than a half of the length of the horizontally polarized antenna 222 in the horizontally polarized direction, and each of the conductive via structures 224A, 224B may be approximately the same as or less than a half of the length of the vertically polarized antenna 224 in the vertically polarized direction. In another embodiment, the horizontally polarized antenna 222 and the vertically polarized antenna 224 may have different resonant frequencies, i.e., the length of the horizontally polarized antenna 222 in the horizontally polarized direction may be different from the length of the vertically polarized antenna 224 in the vertically polarized direction. In addition, the thickness $T_{210}$ of the substrate 210 may be equal to or greater than the length of the vertically polarized antenna 224 in the vertically polarized direction.

The chip 240 has metal bumps 242 toward a side surface of the substrate. By bonding the metal bumps 242 to the bonding pads 216 on the substrate 210, the chip 240 can be mounted on the substrate 210 to have the components in the chip 240 and the conductive lines 212, the conductive via structures 214 and/or the other components in the substrate 210 electrically connected with each other. The metal bumps 242 may be gold bumps, tin bumps or other bumps formed from another metal or metal alloy.

Figure 5B:
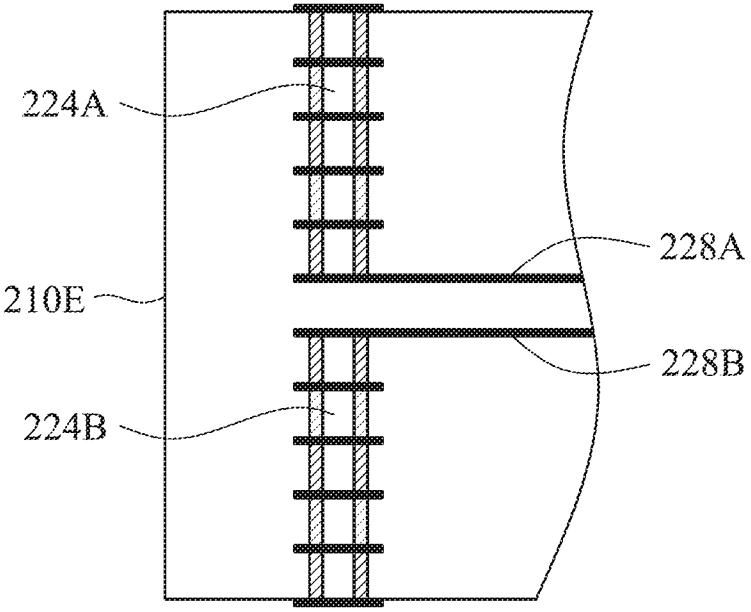
FIG. 5A and FIG. 5B are respectively a top perspective view and a side perspective view of some conductive via structures and feeding traces in FIG. 4.
Figure 5A:
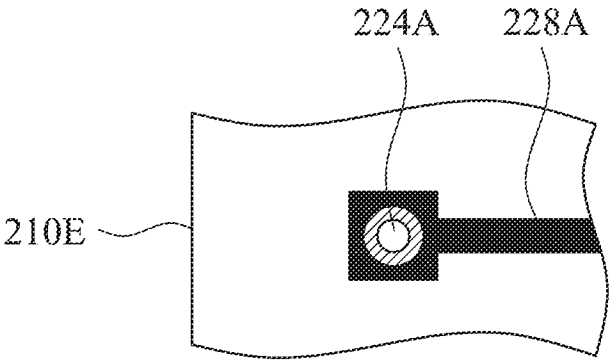

FIG. 5A and FIG. 5B are respectively a top perspective view and a side perspective view of the conductive via structures 224A, 224B of the vertically polarized antenna 224 and the feeding traces 228A, 228B. As shown in FIG. 5A, the conductive via structure 224A are near to the side edge 210E of the substrate 210, and the feeding trace 228A is connected to the conductive via structure 224A and extends in a direction far away from the side edge 210E of the substrate 210. Because the conductive via structure 224B and the feeding trace 228B are respectively right below the conductive via structure 224A and the feeding trace 228A, the conductive via structure 224B and the feeding trace 228B are neither shown in FIG. 5A. In addition, as shown in FIG. 5B, the conductive via structure 224B is also near to the side edge 210E of the substrate 210, and the feeding trace 228B is connected to the conductive via structure 224B and extends in a direction far away from the side edge 210E of the substrate 210. The conductive via structures 224A, 224B are respectively the upper portion and the lower portion of the vertically polarized antenna 224 and are vertically symmetric.

Figure 6B:
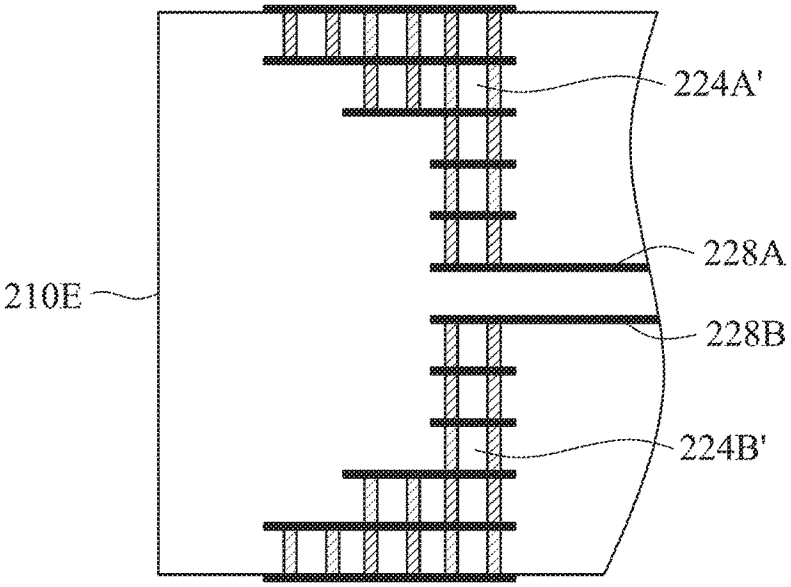
FIG. 6A and FIG. 6B are respectively a top perspective view and a side perspective view of a vertically polarized antenna in accordance with variant embodiments.
Figure 6A:
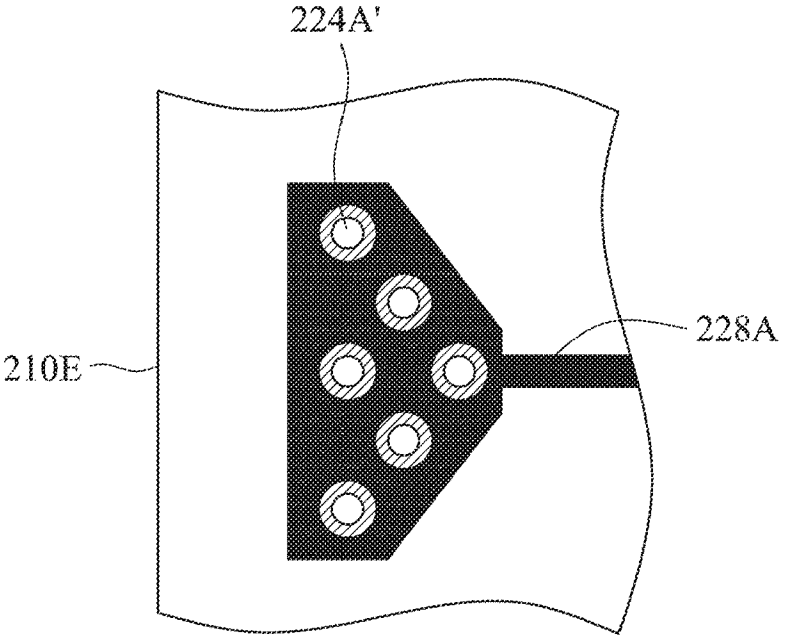

FIG. 6A and FIG. 6B are respectively a top perspective view and a side perspective view of the vertically polarized antenna 224 in accordance with variant embodiments. In variant embodiments of the vertically polarized antenna 224 shown in FIG. 6A and FIG. 6B, the upper half and the lower a half of the vertically polarized antenna 224 are vertically symmetrical and respectively have conductive via structures 224A', 224B' disposed in triangular forms. The conductive via structures 224A', 224B' are near the side edge 210E of the substrate 210, and the feeding traces 228A, 228B are respectively connected to one of the conductive via structures 224A' and one of the conductive via structures 224B' and extend in a direction far away from the side edge 210E of the substrate 210. In variant embodiments of the vertically polarized antenna 224 shown in FIG. 6A and FIG. 6B, the lengths of the conductive via structures 224A' may be different, the lengths of the conductive via structure 224B' may be different, and the conductive via structures 224A' at the upper half of the substrate 210 and the conductive via structures 224B' at the lower half of the substrate 210 may be electrically connected with each other respectively through sheet structures and/or conductive lines of the metal layers in the substrate 210. As such, the resonant bandwidth of the vertically polarized antenna 224 may be further increased.

Figure 7B:
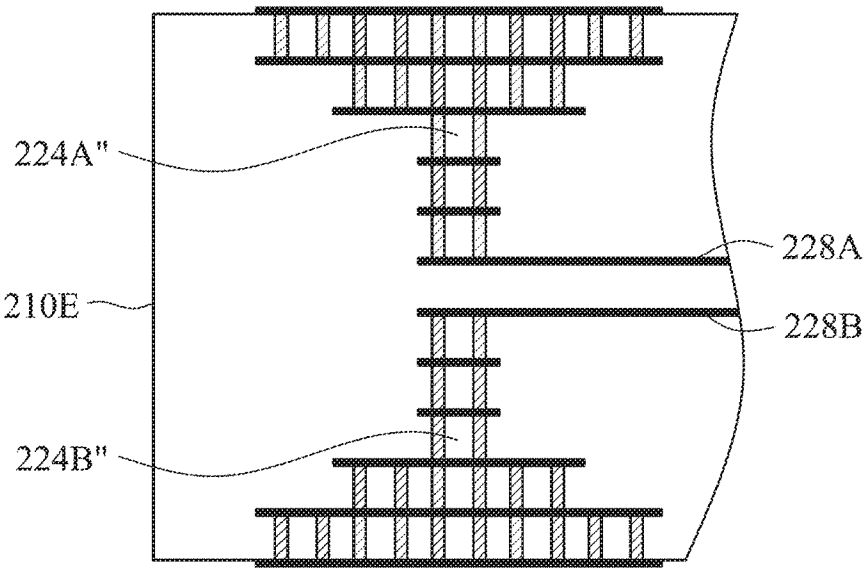
FIG. 7A and FIG. 7B are respectively a top perspective view and a side perspective view of a vertically polarized antenna in accordance with other variant embodiments.
Figure 7A:
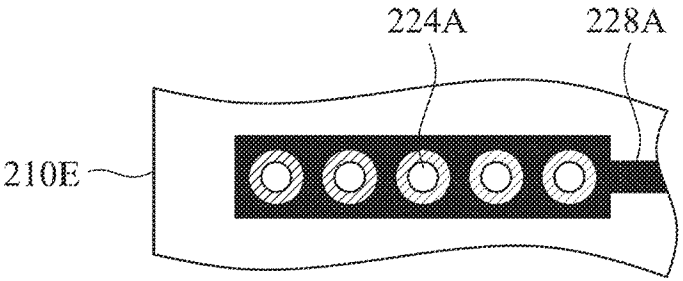

FIG. 7A and FIG. 7B are respectively a top perspective view and a side perspective view of other variant embodiments of the vertically polarized antenna 224. In variant embodiments of the vertically polarized antenna 224 shown in FIG. 7A and FIG. 7B, the upper half and the lower half of the vertically polarized antenna 224 are vertically symmetrical and respectively have conductive via structures 224A", 224B" disposed in strip forms. The conductive via structures 224A", 224B" are near the side edge 210E of the substrate 210, and the feeding traces 228A, 228B are respectively connected to one of the conductive via structure 224A" and one of the conductive via structure 224B" and extend in a direction far away from the side edge 210E of the substrate 210. In addition, as shown in FIG. 7B, the conductive via structures 224A" are symmetrical with respect to a planar strip structure direction, and the conductive via structure 224B" are also symmetrical with respect to a planar strip structure direction. In variant embodiments of the vertically polarized antenna 224 shown in FIG. 7A and FIG. 7B, the lengths of the conductive via structures 224A" may be different, the lengths of the conductive via structure 224B" may be different, and the conductive via structure 224A" at the upper half of the substrate 210 and the conductive via structure 224B" at the lower half of the substrate 210 may be electrically connected with each other respectively through sheet structures and/or conductive lines of the metal layers in the substrate 210. As such, the resonant bandwidth of the vertically polarized antenna 224 may be further increased similarly.

Figure 8:
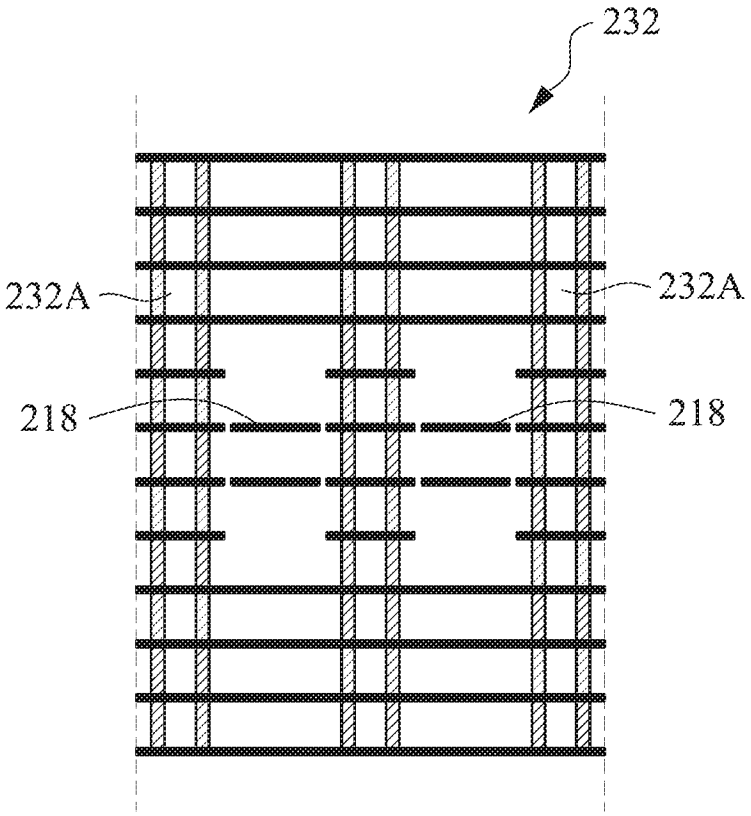
FIG. 8 is a partial cross sectional diagram of the reflective wall in FIG. 3.

FIG. 8 is a partial cross sectional diagram of the reflective wall 232 in FIG. 3. As shown in FIG. 8, conductive via structure 232A are in the same reflective wall 232. The arrangement direction of the conductive via structure 232A may be approximately parallel to the boundary between the center area 210A and the peripheral area 210B of the substrate 210, and the conductive via structures 232A may be electrically connected with each other through the sheet structures of the metal layers in the substrate 210. In addition, the conductive lines 218 may further be between neighboring conductive via structures 232A. These conductive lines 218 may belong to one or more of the metal layers in the substrate 210 and be electrically separated from the reflective wall 232. The horizontally polarized antenna 222 and/or the vertically polarized antenna 224 may be electrically connected to the components in the center area 210A of the substrate 210 through the conductive lines 218. That is, the conductive lines 218 may be configured as the paths for the horizontally polarized antenna 222 and/or the vertically polarized antenna 224 to electrically connect to the components in the center area 210A of the substrate 210 through the reflective wall 232.

Figure 9C:
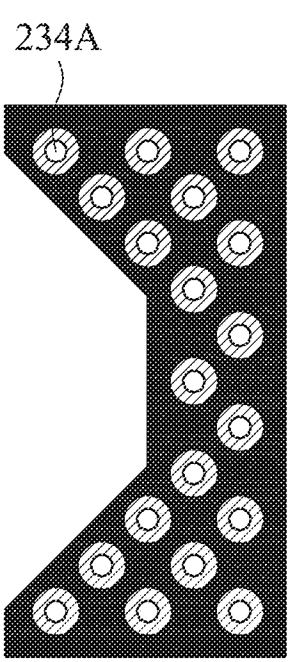
FIG. 9A to FIG. 9C are respectively planar pattern diagrams of the reflective substructure area in FIG. 3 in accordance with variant embodiments.
Figure 9B:
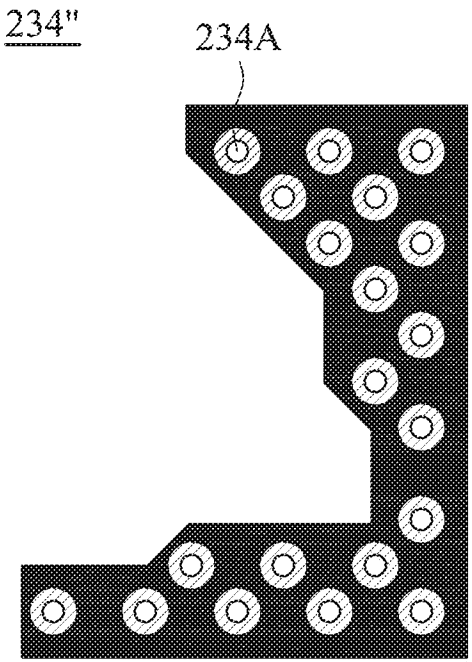
Figure 9A:
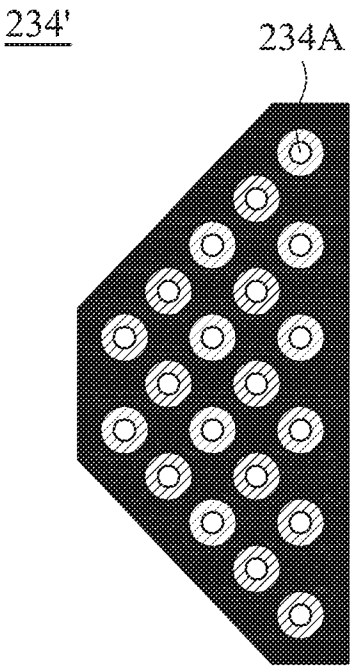
Figure 10A:
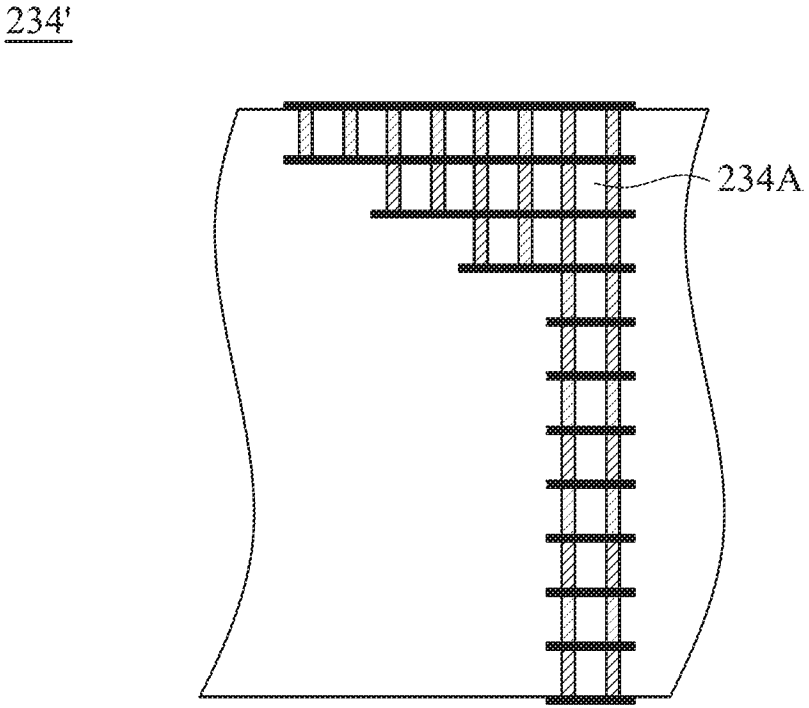
FIG. 10A to FIG. 10C are respectively cross sectional perspective views of the reflective substructure areas in FIG. 9A to FIG. 9C.
Figure 10B:
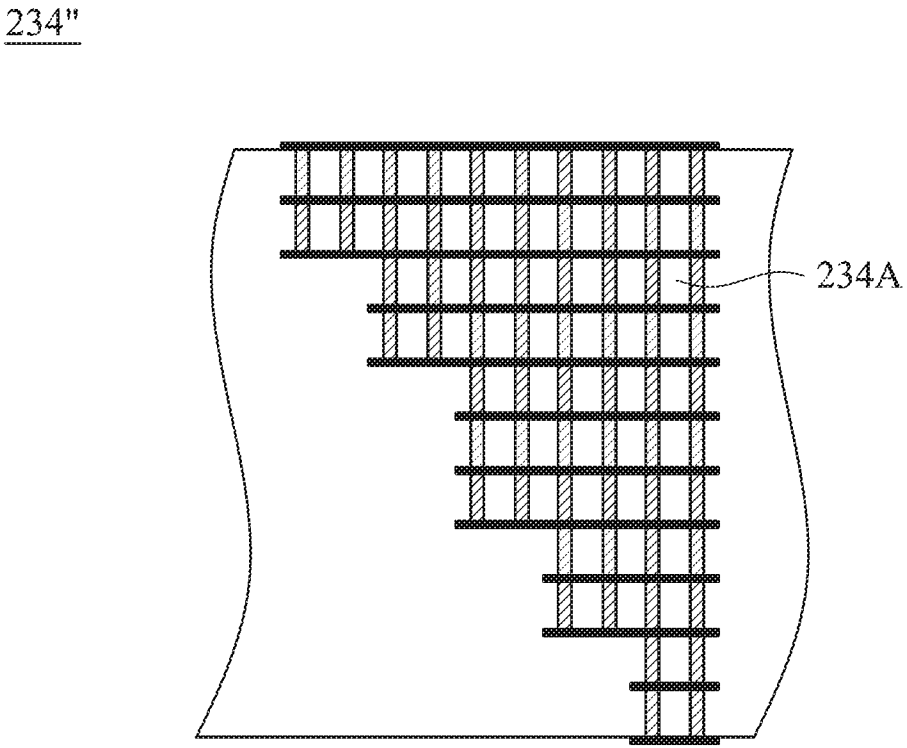
Figure 10C:
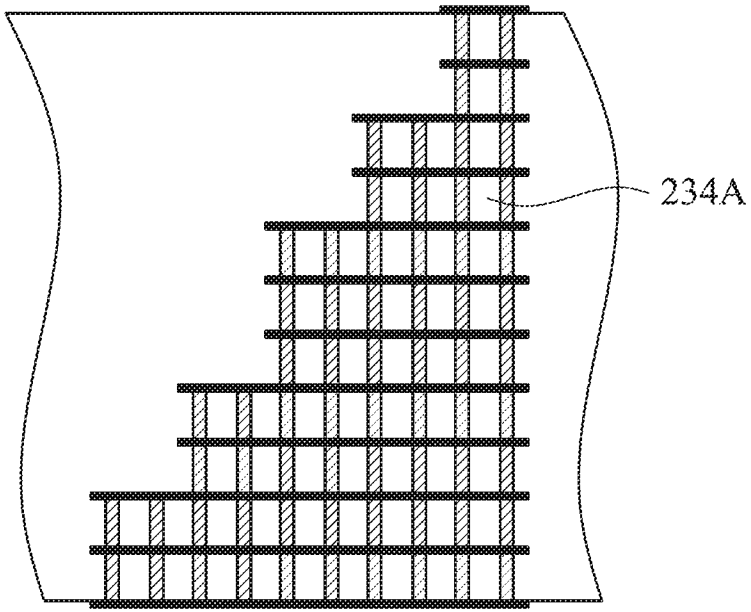

FIG. 9A to FIG. 9C are respectively planar pattern diagrams in variant embodiments of the reflective substructure area 234 in FIG. 3. Reflective substructure areas 234', 234", 234'" are respectively variant embodiments of the reflective substructure area 234 in FIG. 3 and may have different arrangements of the reflective substructures 234A. In addition, the reflective substructures 234A in the reflective substructure areas 234', 234", 234'" may have different heights. FIG. 10A to FIG. 10C are respectively cross sectional perspective views of the reflective substructure areas 234', 234", 234'" in FIG. 9A to FIG. 9C. In the reflective substructure areas 234', 234", 234'" in FIG. 10A to FIG. 10C, the reflective substructures 234A may have different heights, and the longest reflective substructures 234A is approximately the same as the thickness of the substrate 210. Besides, the reflective substructures 234A may be electrically connected with each other respectively through sheet structures and/or conductive lines of the metal layers in the substrate 210. In variant embodiments of the reflective substructure area 234 in FIG. 9A to FIG. 10C, all of the reflective substructure areas 234', 234", 234'" have particular electromagnetic wave reflective angles and directions, which may be respectively applied to various usage requirements.

The conductive via structures 214, 224A, 224B, 232A in the integrated antenna structure 200 may be consisted of one or more types. As shown in FIG. 4 and FIG. 8, the conductive via structures 214 include blind via structures and buried via structures, the conductive via structures 224A, 224B are all blind via structures, and the conductive via structures 232A are through via structures. However, embodiments of the invention are not limited thereto. For example, in another embodiment, the conductive via structures 214 and the conductive via structures 232A may include blind via structures, buried via structures and/or through via structures, while the conductive via structures 224A, 224B may be buried via structures, which may be determined according to design requirements.

In addition, as shown in FIG. 4 and FIG. 8, the conductive via structures 214, 224A, 224B, 232A are plated conductive via structures in which conductive material is plated onto the walls of the via holes, such as copper, gold, aluminum, nickel or another metal, and then a conductive material or an insulating material (e.g. air or epoxy resin) is filled or plugged into the remained spaces, or a conductive material or an insulating material is plugged to form plugged via structures, or a solder mask is disposed on the top and/or the bottom of the spaces to form tented via structures. In another embodiment, the conductive via structures 214, 224A, 224B, 232A may be non-plated conductive via structures, in which conductive material is directly filled into the via holes, such as metal of copper, gold, aluminum, nickel, but are not limited thereto.

The integrated antenna structure in accordance with another embodiment of the invention relating to the description of types of the conductive via structures may be as the description of types of the conductive via structures 214, 224A, 224B, 232A of the integrated antenna structure 200, and therefore the description of types of the conductive via structures (including the reflective wall and the conductive via structures in the vertically polarized antennas) for another integrated antenna structure is not mentioned again herein.

Figure 11:
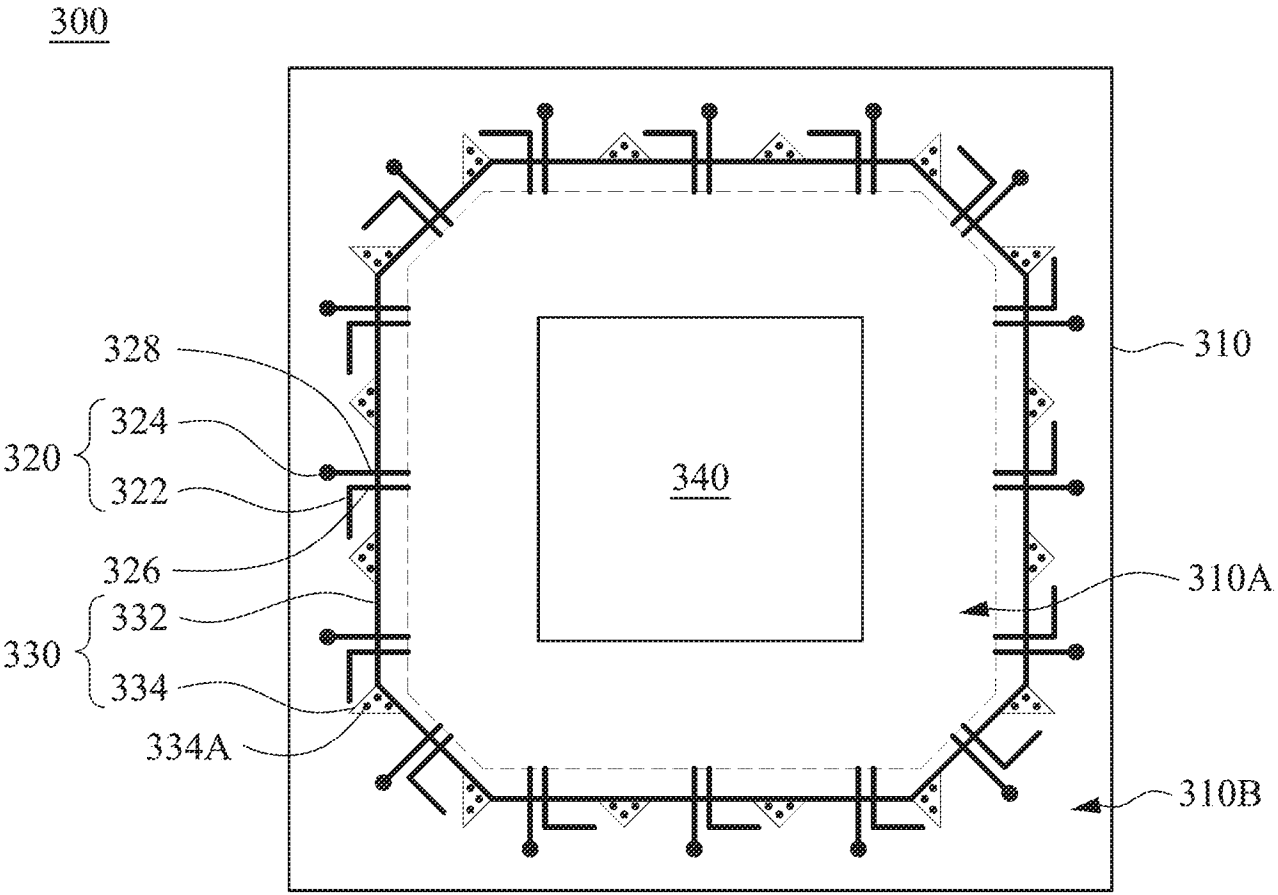
FIG. 11 is a schematic arrangement diagram of an integrated antenna structure in accordance with some embodiments of the invention.

FIG. 11 is a schematic arrangement diagram of an integrated antenna structure 300 in accordance with some embodiments of the invention. The integrated antenna structure 300 includes a substrate 310, dual-polarized antenna units 320, a reflective structure 330 and a chip 340. As shown in FIG. 11, the arrangements of the dual-polarized antenna unit 320, the reflective structure 330 and the chip 340 in the substrate 310 are similar to the arrangements of the dual-polarized antenna units 320, the reflective structure 330 and the chip 340 in the substrate 310 shown in FIG. 3. The substrate 310 may be a multi-layered structure, which has a structure of alternately stacked dielectric layers and metal layers as illustrated in FIG. 2. The dual-polarized antenna units 320 include horizontally polarized antennas 322 and vertically polarized antennas 324. The horizontally polarized antennas 322 are configured to generate horizontally polarized beams, and the vertically polarized antennas 324 are configured to generate vertically polarized beams. The horizontally polarized antennas 322 and the vertically polarized antennas 324 are electrically coupled to the components in the center area 310A of the substrate 310 respectively through feeding traces 326, 328. The reflective structure 330 includes a reflective wall 332 and reflective substructure areas 334 each consisting of reflective substructures 334A. The chip 340 has an RFIC and/or other active and/or passive components for constituting a transmitting and/or receiving circuit. The components in the chip 340 and in and/or on the substrate 310 may be electrically connected with each other through the bonding pads on a side surface of the substrate 310.

Figure 12:
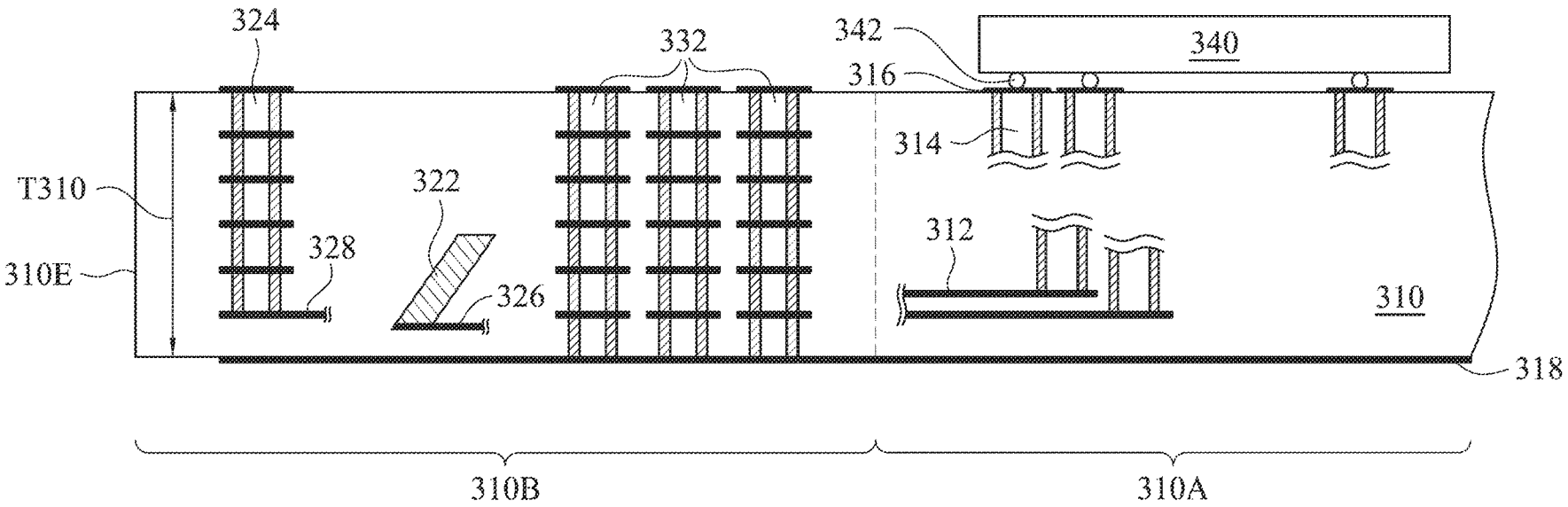
FIG. 12 is a partial structural diagram of the integrated antenna structure in FIG. 11.

FIG. 12 is a partial structural diagram of the integrated antenna structure 300 in FIG. 11. In the partial structural diagram shown in FIG. 12, a dual-polarized antenna unit 320 (which includes a horizontally polarized antenna 322 and a vertically polarized antenna 324) is disposed in the peripheral area 310B of the substrate 310, the reflective wall 332 is disposed between the dual-polarized antenna unit 320 and the center area 310A of the substrate 310, and the chip 340 is disposed on the substrate 310 and in the center area 310A of the substrate 310.

As shown in FIG. 12, the horizontally polarized antenna 322 is a monopole antenna. The horizontally polarized antenna 322 is a monopole arm coupled to the feeding trace 326, and the feeding trace 326 may penetrate through the reflective wall 332 to electrically couple to the components in the center area 310A, such that the horizontally polarized antenna 322 is electrically connected to the conductive lines 312, the conductive via structure 314 and/or the other components in the center area 310A. The vertically polarized antenna 324 is a conductive via structure electrically coupled to the feeding trace 328, and the feeding trace 328 may penetrate through the reflective wall 332 to electrically couple to the components in the center area 310A, such that the vertically polarized antenna 324 is electrically connected to the conductive lines 312, the conductive via structure 314 and/or the other components in the center area 310A. The dual-polarized antenna unit 320 is between the side edge 310E of the substrate 310 and the reflective wall 332, in which the vertically polarized antenna 324 is nearer to the side edge 310E of the substrate 310 than the horizontally polarized antenna 322. In another embodiment, the horizontally polarized antenna 322 is nearer to the side edge 310E of the substrate 310 than the vertically polarized antenna 324, or alternatively the distance between the horizontally polarized antenna 322 and the side edge 310E of the substrate 310 is approximately the distance between the vertically polarized antenna 324 and the side edge 310E of the substrate 310.

The chip 340 has metal bumps 342 toward a side surface of the substrate. By bonding the metal bumps 342 to the bonding pads 316 on the substrate 310, the chip 340 can be mounted on the substrate 310 to have the components in the chip 340 and the conductive lines 312, the conductive via structures 314 and/or the other components in the substrate 340 electrically connected with each other. The ground plane 318 is disposed on a side of the substrate 310 far away from the chip 340. With the mirroring effect provided by the ground plane 318, the horizontally polarized antenna 322 and/or the vertically polarized antenna 324 may generate similar current distribution and radiation pattern as those of a dipole antenna.

According to the aforementioned content, the length of the horizontally polarized antenna 322 in the horizontally polarized direction and the length of the vertically polarized antenna 324 in the vertically polarized direction may be approximately a quarter of the equivalent wavelength of the electromagnetic wave in the substrate 310. The length $L_{322}$ of the horizontally polarized antenna 322 in the horizontally polarized direction may be approximately about:

$$L_{322} = \frac{c_0}{4f_{322}\sqrt{\varepsilon_{310}}}, \quad (3)$$

where $c_0$ is the velocity of the electromagnetic wave in the air, $f_{322}$ is the resonant frequency of the horizontally polarized antenna 322, and $\varepsilon_{310}$ is the relative dielectric constant of the substrate 310. The length $L_{324}$ of the vertically polarized antenna 324 in the vertically polarized direction may be approximately:

$$L_{324} = \frac{c_0}{4f_{324}\sqrt{\varepsilon_{310}}}, \quad (4)$$

where $f_{324}$ is the resonant frequency of the vertically polarized antenna 324. As can be seen from above, the length of the horizontally polarized antenna 322 in the horizontally polarized direction and the length of the vertically polarized antenna 324 in the vertically polarized direction may be determined according to the resonant frequency thereof and the relative dielectric constant of the substrate 310. As can be seen from above, the length $L_{322}$ of the horizontally polarized antenna 322 in the horizontally polarized direction may be determined according to the resonant frequency $f_{322}$ of the horizontally polarized antenna 322 and the relative dielectric constant $\varepsilon_{310}$ of the substrate 310, and the length $L_{324}$ of the vertically polarized antenna 324 in the vertically polarized direction may be determined according to the resonant frequency $f_{324}$ of the vertically polarized antenna 324 and the relative dielectric constant $\varepsilon_{310}$ of the substrate 310.

In another embodiment, the horizontally polarized antenna 322 and the vertically polarized antenna 324 may have different resonant frequencies, i.e., the length of the horizontally polarized antenna 322 in the horizontally polarized direction may different from the length of the vertically polarized antenna 324 in the vertically polarized direction. In addition, the thickness $T_{310}$ of the substrate 310 may be equal to or greater than the length of the vertically polarized antenna 324 in the vertically polarized direction.

The components in the integrated antenna structure 300 other than the substrate 310, the ground plane 318, the horizontally polarized antennas 322, the vertically polarized antennas 324 and the feeding traces 326, 328 may be respectively similar to the components of the integrated antenna structure 200 in FIG. 3 and FIG. 4 other than the substrate 210, the horizontally polarized antennas 222, the vertically polarized antennas 224 and the feeding traces 226A, 226B, 228A, 228B, and therefore the related description can be referred to the foregoing paragraphs and is not repeated herein.

Figure 13:
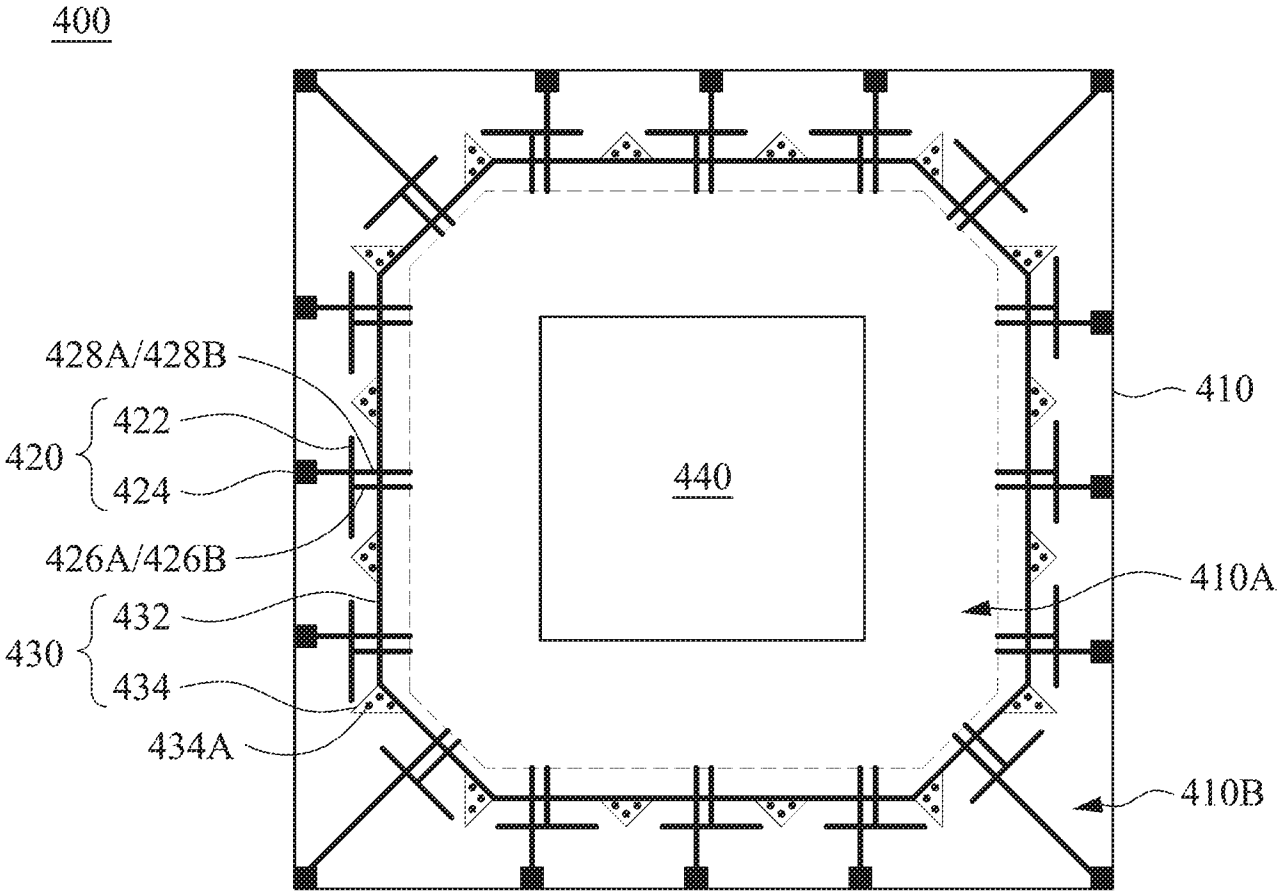
FIG. 13 is a schematic arrangement diagram of an integrated antenna structure in accordance with some embodiments of the invention.

FIG. 13 is a schematic arrangement diagram of an integrated antenna structure 400 in accordance with some embodiments of the invention. the integrated antenna structure 400 includes as substrate 410, dual-polarized antenna units 420, a reflective structure 430 and a chip 440. As shown FIG. 13, the arrangements of the reflective structure 430 and the chip 440 in the substrate 410 are similar to the arrangements of the reflective structure 230 and the chip 240 in the substrate 210 shown in FIG. 3. The substrate 410 may be a multi-layered structure, which has a structure of alternately stacked dielectric layers and metal layers as illustrated in FIG. 2. The dual-polarized antenna units 420 include horizontally polarized antennas 422 and vertically polarized antennas 424. The horizontally polarized antennas 422 are configured to generate horizontally polarized beams, and the vertically polarized antennas 424 are configured to generate a vertically polarized beams. The horizontally polarized antennas 422 and the vertically polarized antennas 424 are electrically coupled to the components in the center area 410A of the substrate 410 respectively through the feeding traces 426A, 426B, 428A, 428B. The reflective structure 430 includes a reflective wall 432 and reflective substructure areas 434 each consisting of reflective substructures 434A. The chip 440 has an RFIC and/or other active and/or passive components for constituting a transmitting and/or receiving circuit. The components in the chip 440 and in and/or on the substrate 410 may be electrically connected with each other through the bonding pads on a side surface of the substrate 410.

Figure 14:
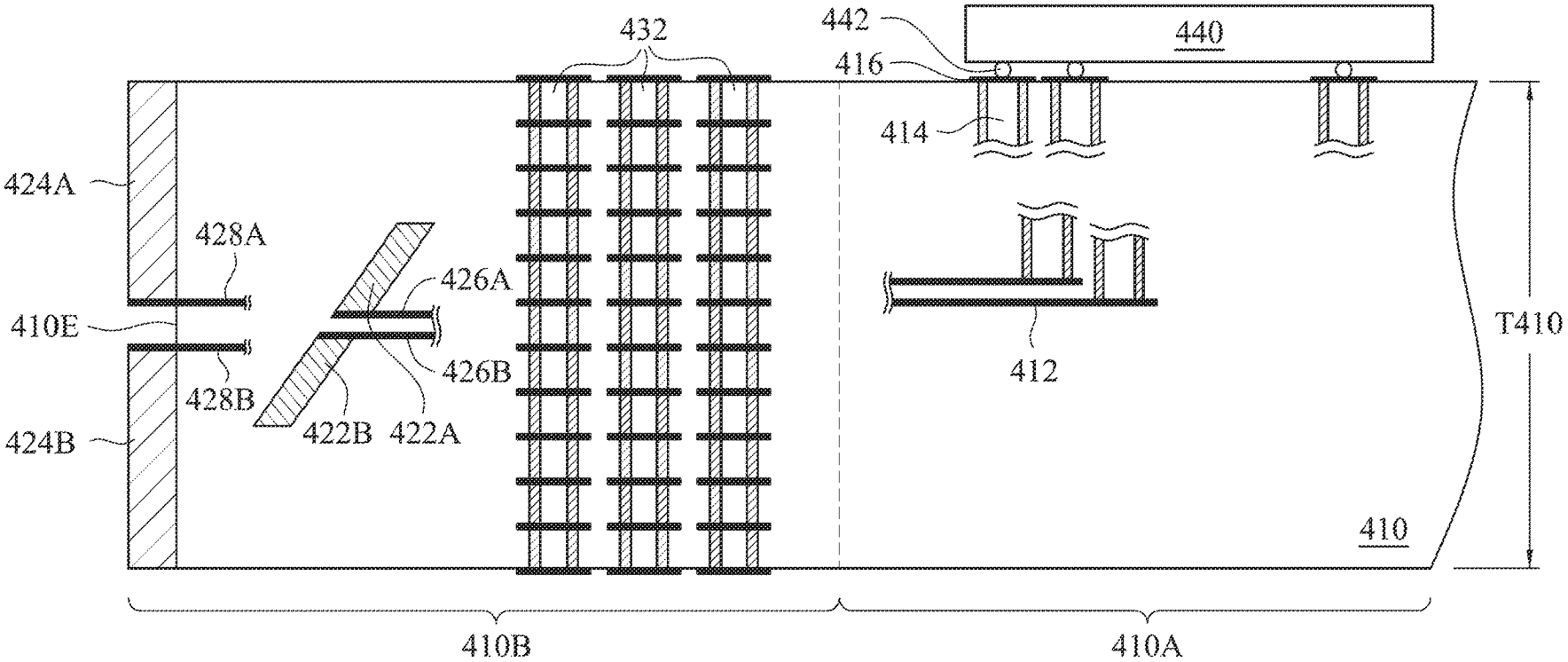
FIG. 14 is a partial structural diagram of the integrated antenna structure in FIG. 13.

FIG. 14 is a partial structural diagram of the integrated antenna structure 400 in FIG. 13. In the partial structural diagram shown in FIG. 14, a dual-polarized antenna unit 420 (which includes a horizontally polarized antenna 422 and a vertically polarized antenna 424) is disposed in the peripheral area 410B of the substrate 410, in which the vertically polarized antenna 424 is on the side edge 410E of the substrate 410, and the horizontally polarized antenna 422 is between the side edge 410E of the substrate 410 and the reflective wall 432. The reflective wall 432 is disposed between the dual-polarized antenna unit 420 and the center area 410A of the substrate 410, and the chip 440 is disposed on the substrate 410 and in the center area 410A of the substrate 410.

As shown in FIG. 14, the horizontally polarized antenna 422 and the vertically polarized antenna 424 are all microstrip dipole antennas. The horizontally polarized antenna 422 includes two dipole arms 422A, 422B respectively electrically coupled to the feeding traces 426A, 426B. The vertically polarized antenna 424 includes two dipole arms 424A, 424B respectively electrically coupled to the feeding traces 428A, 428B. The feeding traces 426A, 426B, 428A, 428B may penetrate through the reflective wall 432 to respectively electrically couple to the components in the center area 410A, such that the dipole arms 422A, 422B, 424A, 424B are respectively electrically connected to the conductive lines 412, the conductive via structures 414 and/or the other components in the center area 210A.

Academically, the resonant frequency of the vertically polarized antenna 424 is dependent from the lengths of the dipole arms 424A, 424B. The length of the vertically polarized antenna 424 in the vertically polarized direction may be approximately a half of the equivalent wavelength of the electromagnetic wave in the substrate 410 and may be dependent from the resonant frequency thereof and the relative dielectric constant of the substrate 410. The relationship between the length of the vertically polarized antenna 424 in the vertically polarized direction, the resonant frequency of the vertically polarized antenna 424 and the relative dielectric constant of the substrate 410 is similar to Equation (2) and therefore is not repeated herein. The length of each of the dipole arms 424A, 424B may be approximately the same as or less than a half of the length of the vertically polarized antenna 424 in the vertically polarized direction. The horizontally polarized antenna 422 and the vertically polarized antenna 424 may have the same resonant frequency or alternatively have different resonant frequencies. In addition, the thickness $T_{410}$ of the substrate 410 may be equal to or greater than the length of the vertically polarized antenna 424 in the vertically polarized direction.

The chip 440 has metal bumps 442 toward a side surface of the substrate. By bonding the metal bumps 442 to the bonding pads 416 on the substrate 410, the chip 440 can be mounted on the substrate 410 to have the components in the chip 440 and the conductive lines 412, the conductive via structures 414 and/or the other components in the substrate 410 electrically connected with each other.

The components in the integrated antenna structure 400 other than the vertically polarized antennas 424 and the feeding traces 428A, 428B may be respectively similar to the components in the integrated antenna structure 200 in FIG. 3 and FIG. 4 other than the vertically polarized antennas 224 and the feeding traces 228A, 228B, and therefore the related description can be referred to the foregoing paragraphs and is not repeated herein.

Figure 15:
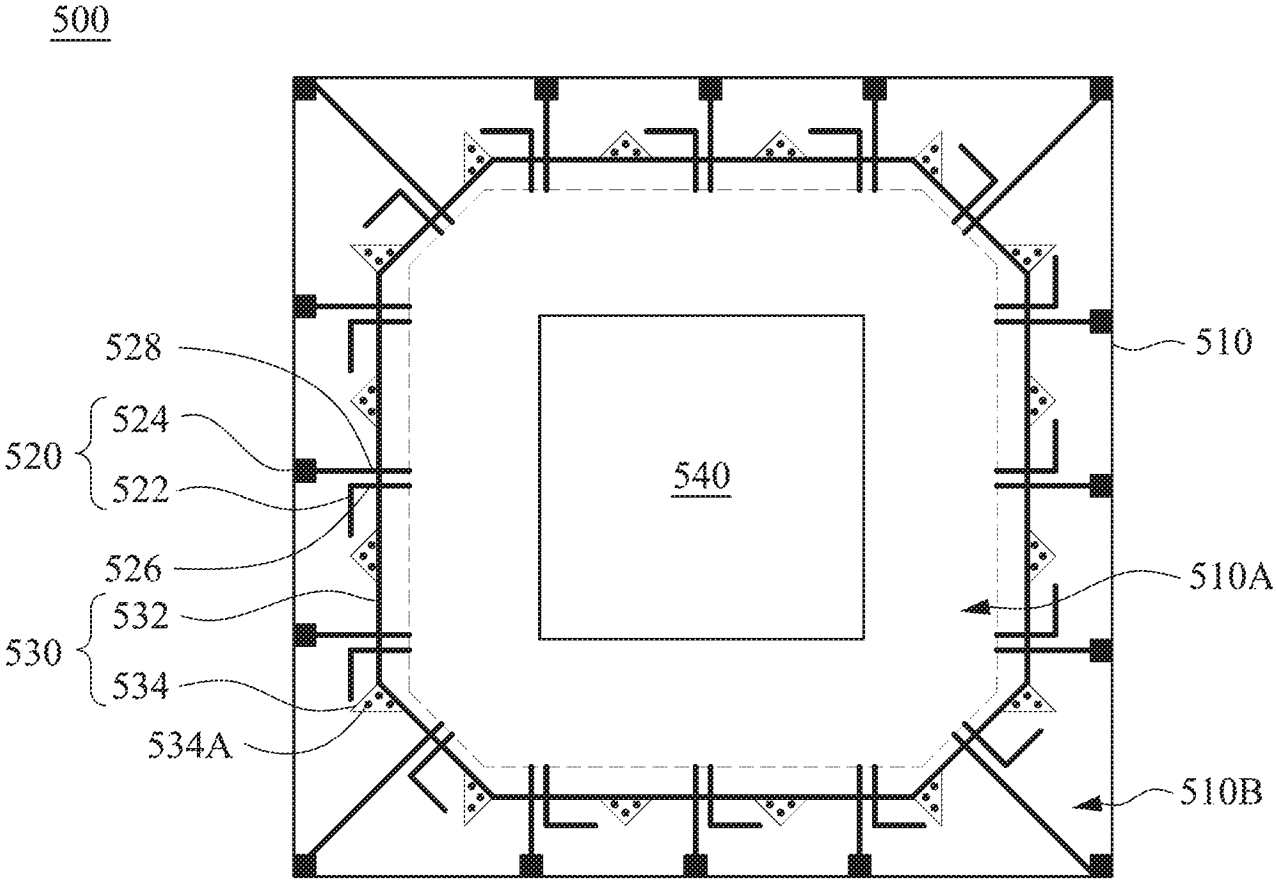
FIG. 15 is a schematic arrangement diagram of an integrated antenna structure in accordance with some embodiments of the invention.

FIG. 15 is a schematic arrangement diagram of an integrated antenna structure 500 in accordance with some embodiments of the invention. The integrated antenna structure 500 includes a substrate 510, dual-polarized antenna units 520, a reflective structure 530 and a chip 540. As shown in FIG. 15, the arrangements of the dual-polarized antenna units 520, the reflective structure 530 and the chip 540 in the substrate 510 are similar to the arrangements of the dual-polarized antenna units 420, the reflective structure 430 and the chip 440 in the substrate 410 shown in FIG. 13. The substrate 510 may be a multi-layered structure, which has a structure of alternately stacked dielectric layers and metal layers as illustrated in FIG. 2. The dual-polarized antenna units 520 include horizontally polarized antennas 522 and vertically polarized antennas 524. The horizontally polarized antennas 522 are configured to generate horizontally polarized beams, and the vertically polarized antennas 524 are configured to generate vertically polarized beams. The horizontally polarized antenna 522 and the vertically polarized antenna 524 are electrically coupled to the components in the center area 510A of the substrate 510 respectively through the feeding traces 526, 528. The reflective structure 530 includes a reflective wall 532 and reflective substructure areas 534 each consisting of reflective substructures 534A. The chip 540 has an RFIC and/or other active and/or passive components for constituting a transmitting and/or receiving circuit. The components in the chip 540 and in and/or on the substrate 510 may be electrically connected with each other through the bonding pads on a side surface of the substrate 510.

Figure 16:
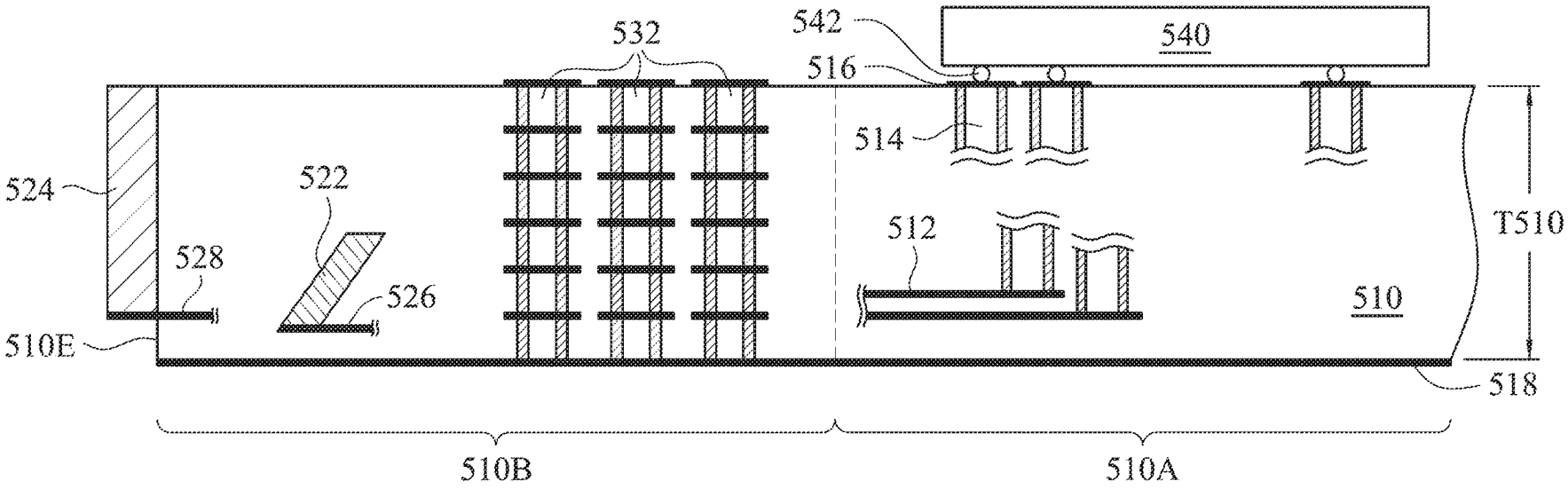
FIG. 16 is a partial structural diagram of the integrated antenna structure in FIG. 15.

FIG. 16 is a partial structural diagram of the integrated antenna structure 500 in FIG. 15. In the partial structural diagram shown in FIG. 16, a dual-polarized antenna unit 520 (which includes a horizontally polarized antenna 522 and a vertically polarized antenna 524) is disposed in the peripheral area 510B of the substrate 510. In which the vertically polarized antenna 524 is on the side edge 510E of the substrate 510, and the horizontally polarized antenna 522 is between the side edge 510E of the substrate 510 and the reflective wall 532. The reflective wall 532 is disposed between the dual-polarized antenna unit 520 and the center area 510A of the substrate 510, and the chip 540 is disposed on the substrate 510 and in the center area 510A of the substrate 510.

As shown in FIG. 16, the horizontally polarized antenna 522 and the vertically polarized antenna 524 are all microstrip monopole antennas respectively electrically coupled to the feeding traces 526, 528. The feeding traces 526, 528 may penetrate through the reflective wall 532 to respectively electrically couple to the components in the center area 510A, such that the horizontally polarized antenna 522 and the vertically polarized antenna 524 are respectively electrically to the conductive lines 512, the conductive via structure 514 and/or other components in the center area 510A.

The chip 540 has metal bumps 542 toward a side surface of the substrate. By bonding the metal bumps 542 to the bonding pads 516 on the substrate 510, the chip 540 can be mounted on the substrate 510 to have the components in the chip 540 and the conductive lines 512, the conductive via structures 514 and/or the other components in the substrate 510 electrically connected with each other. The ground plane 518 is disposed on a side of the substrate 510 far away from the chip 540. With the mirroring effect provided by the ground plane 51, the horizontally polarized antenna 522 and/or the vertically polarized antenna 524 may generate similar current distribution and radiation pattern as those of a dipole antenna.

Academically, the length of the vertically polarized antenna 524 in the vertically polarized direction may be approximately a quarter of the equivalent wavelength of the electromagnetic in the substrate 510 and may be dependent from the resonant frequency thereof and the relative dielectric constant of the substrate 510. The relationship between the length of the vertically polarized antenna 524 in the vertically polarized direction, the resonant frequency of the vertically polarized antenna 524 and the relative dielectric constant of the substrate 510 is similar to Equation (4) and therefore is not repeated herein. The horizontally polarized antenna 522 and the vertically polarized antenna 524 may have the same resonant frequency or alternatively have different resonant frequencies. In addition, the thickness $T_{510}$ of the substrate 510 may be the same as or greater than the length of the vertically polarized antenna 524 in the vertically polarized direction.

The components in the integrated antenna structure 500 other than the vertically polarized antennas 524 and the feeding traces 528 may be respectively similar to the components in the integrated antenna structure 300 in FIG. 11 and FIG. 12 other than the vertically polarized antennas 324 and the feeding traces 328A, 328B, and the components in the integrated antenna structure 500 other than the substrate 510, the horizontally polarized antennas 522, the vertically polarized antennas 524 and the feeding traces 526, 528 may be similar to the components in the integrated antenna structure 400 in FIG. 13 and FIG. 14 other than the substrate 410, the horizontally polarized antennas 422, the vertically polarized antennas 424 and the feeding traces 426A, 426B, 428A, 428B, and therefore the related description can be referred to the foregoing paragraphs and is not repeated herein.

Figure 17:
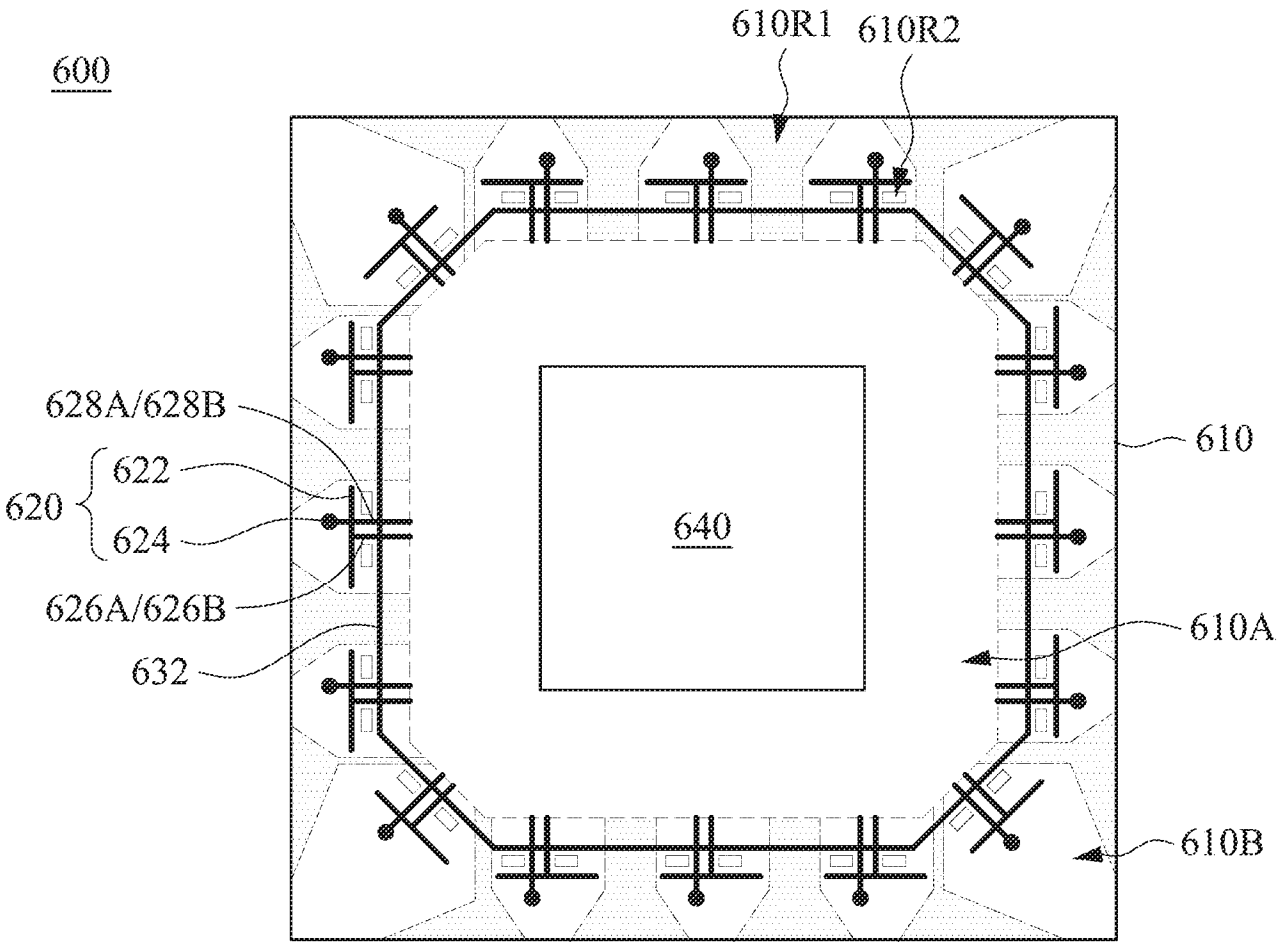
FIG. 17 is a schematic arrangement diagram of an integrated antenna structure in accordance with some embodiments of the invention.

FIG. 17 a schematic arrangement diagram of an integrated antenna structure 600 in accordance with some embodiments of the invention. The integrated antenna structure 600 includes a substrate 610, dual-polarized antenna units 620, a reflective wall 632 and a chip 640.

As shown in FIG. 17, the substrate 610 has a center area 610A and a peripheral area 610B. The substrate 610 may be a multi-layered structure, which has a structure of alternately stacked dielectric layers and metal layers as illustrated in FIG. 2. The peripheral area 610B of the substrate 610 has dielectric lens areas 610R1 and 610R2. Each of the dielectric lens areas 610R1 is located between corresponding two neighboring dual-polarized antenna units 620, and each of the dielectric lens areas 610R2 is located between the corresponding dual-polarized antenna unit 620 and the reflective wall 632.

The dual-polarized antenna units 620 are disposed in the substrate 610 and are located in the peripheral area 610B of the substrate 610. The dual-polarized antenna units 620 include horizontally polarized antennas 622 and vertically polarized antennas 624. The horizontally polarized antennas 622 are configured to generate horizontally polarized beams, and the vertically polarized antennas 624 are configured to generate vertically polarized beams. The gains, the widths and the half-power beam widths (HPBW) of the respectively generated horizontally polarized beams and vertically polarized beams of the dual-polarized antenna units 620 are related to the types of the shapes of the horizontally polarized antennas 622 and the vertically polarized antennas 624. The horizontally polarized antennas 622 and the vertically polarized antennas 624 are electrically coupled to the components in the center area 610A of the substrate 610 respectively through feeding traces 626A/626B, 628A/628B. The horizontally polarized antennas 622 may be in one of the metal layers, and the vertically polarized antennas 624 may be vertically across multiple dielectric layers. In addition, the feeding traces 626A/626B, 628A/628B may also be in one or more of the metal layers. Various embodiments of the horizontally polarized antennas 622 and the vertically polarized antennas 624 will be described in the following paragraphs.

The reflective wall 632 may be used to increase the directivity of the antenna units and to block radiation waves from interfering the components in the center area 610A. The reflective wall 632 may be vertically across multiple dielectric layers, and may be formed from copper, aluminum, nickel and/or another metal.

The chip 640 has a radio frequency integrated circuit (RFIC) and/or other active and/or passive components for constituting a transmitting and/or receiving circuit. The components in the chip 640 and in and/or on the substrate 610 may be electrically connected with each other through the bonding pads on a side surface of the substrate 610.

Figure 18:
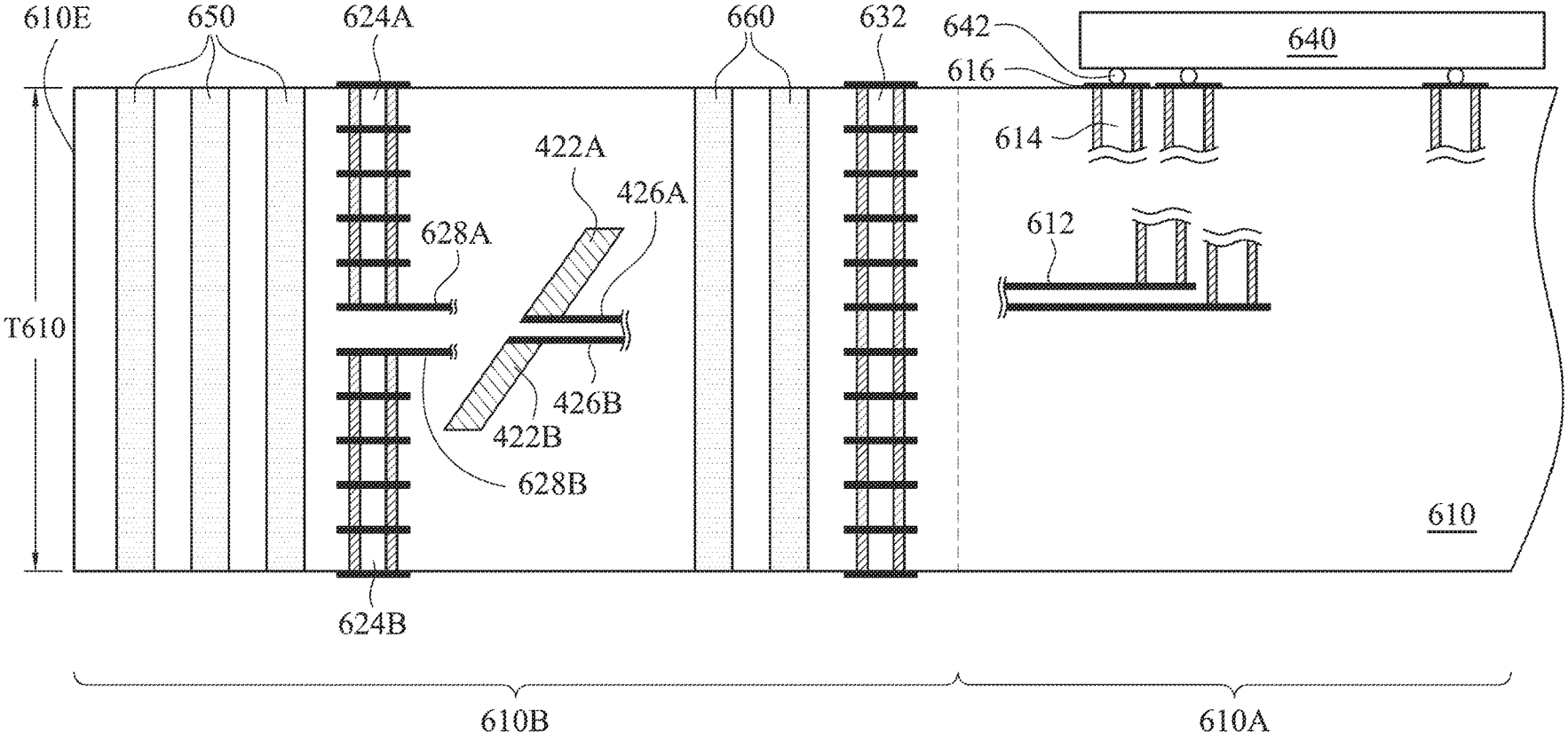
FIG. 18 is a partial structural diagram of the integrated antenna structure in FIG. 17.

FIG. 18 is a partial structural diagram of the integrated antenna structure 600 in FIG. 17. In the partial structural diagram shown in FIG. 18, a dual-polarized antenna unit 620 (which includes a horizontally polarized antenna 622 and a vertically polarized antenna 624) is disposed in the peripheral area 610B of the substrate 610, in which the vertically polarized antenna 624 is nearer to the side edge 610E of the substrate 610 than the horizontally polarized antenna 622. In another embodiment, the horizontally polarized antenna 622 may be nearer to the side edge 610E of the substrate 610 than the vertically polarized antenna 624, or alternatively the distance between the horizontally polarized antenna 622 and the side edge 610E of the substrate 610 is approximately the distance between the vertically polarized antenna 624 and the side edge 610E of the substrate 610.

The reflective wall 632 is disposed between dielectric lenses 650 and the center area 610A of the substrate 610, and the chip 640 is disposed on the substrate 610 and in the center area 610A of the substrate 610. In the peripheral area 610B of the substrate 610, the dielectric lenses 650 are disposed between the side edge 610E of the substrate 610 and the vertically polarized antenna 624, and the dielectric lenses 660 are disposed between the horizontally polarized antenna 622 and the reflective wall 632.

As shown in FIG. 18, the horizontally polarized antenna 622 is a microstrip dipole antenna. The horizontally polarized antenna 622 includes two dipole arms 622A, 622B respectively electrically coupled to the feeding traces 626A, 626B. The vertically polarized antenna 624 includes conductive via structures 624A, 624B respectively electrically coupled to the feeding traces 628A, 628B. The feeding traces 626A, 626B, 628A, 628B may penetrate through the reflective wall 632 and the disposed area of the dielectric lenses 660 to respectively couple to the components in the center area 610A, such that the dipole arms 622A, 622B are respectively electrically connected to the conductive lines 612, the conductive via structures 614 and/or the other components in the center area 610A. The dipole arms 622A, 622B and the feeding traces 626A, 626B, 628A, 628B may be in the same one or in two or more of the metal layers in the substrate 610, and each of the feeding traces 626A, 626B, 628A, 628B may be electrically connected to conductive lines or other components in different layers through the conductive via structures which penetrate through the dielectric layers.

The resonant frequencies of the horizontally polarized antenna 622 and the vertically polarized antenna 624 are dependent from the dipole arms 622A, 622B and the conductive via structures 624A, 624B. The lengths of the dipole arms 622A, 622B and the conductive via structures 624A, 624B may be designed by referencing the aforementioned description regarding the dipole arms 222A, 222B and the conductive via structures 224A, 224B of the integrated antenna structure 200 and thus is not described again herein. The horizontally polarized antenna 622 and the vertically polarized antenna 624 may have the same resonant frequency or alternatively have different resonant frequencies. In addition, the thickness $T_{610}$ of the substrate 610 may be equal to or greater than the length of the vertically polarized antenna 624 in the vertically polarized direction.

The chip 640 has metal bumps 642 toward a side surface of the substrate. By bonding the metal bumps 642 to the bonding pads 616 on the substrate 610, the chip 640 can be mounted on the substrate 610 to have the components in the chip 640 and the conductive lines 612, the conductive via structures 614 and/or the other components in the substrate 610 electrically connected with each other.

The dielectric lenses 650 are used to change the horizontally polarized beam generated by the horizontally polarized antenna 622 and the vertically polarized beam generated by the vertically polarized antenna 624, such that the strength distributions of the horizontally polarized beam and the vertically polarized beam may be more concentrated, that is, the directivities of the horizontally polarized beam and the vertically polarized beam are enhanced. In addition, as shown in FIG. 17, the dielectric lenses 650 are in the dielectric lens areas 610R1.

The dielectric lenses 660 are used to change the horizontally polarized beam generated by the horizontally polarized antenna 622 and the vertically polarized beam generated by the vertically polarized antenna 624 and to block radiation wave from interfering the components in the center area 610A. In addition, as shown in FIG. 17, the dielectric lenses 660 are in the dielectric lens area 610R2. In another embodiment, the integrated antenna structure 600 may include only the dielectric lenses 660 and may not include the reflective wall 632.

Figure 19C:
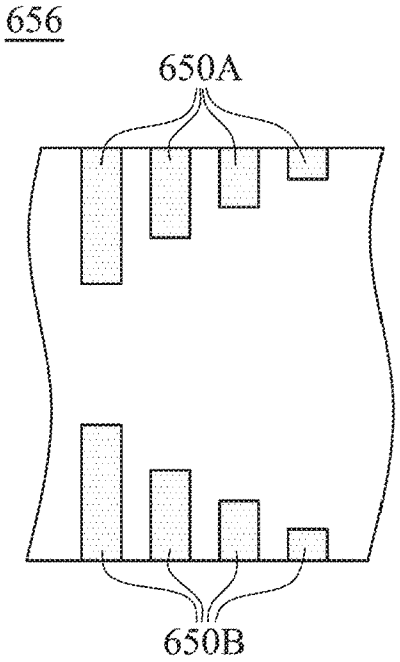
FIG. 19A to FIG. 19C are respectively cross sectional diagrams of the dielectric lens area in FIG. 17 in accordance with various embodiments.
Figure 19B:
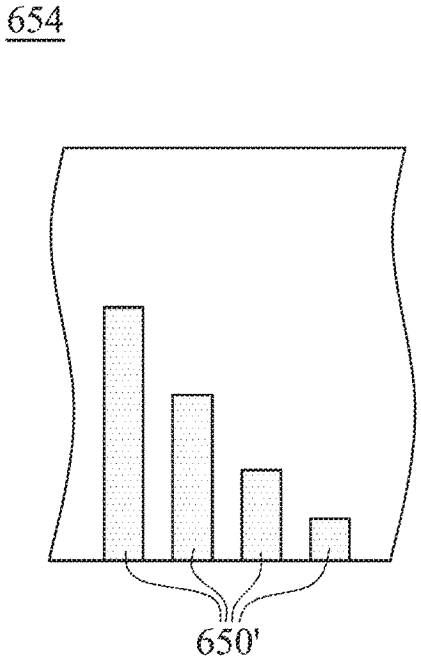
Figure 19A:
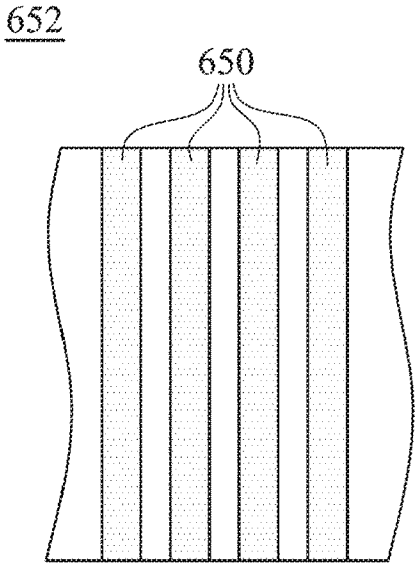

FIG. 19A to FIG. 19C are respectively cross sectional diagrams of the dielectric lens area 610R1 in FIG. 17 in accordance with various embodiments. In FIG. 19A, the dielectric lens area 652 includes dielectric lenses 650 that penetrate through the substrate 610. In FIG. 19B, the dielectric lens area 654 includes dielectric lenses 650' extending upwards from the lower side of the substrate 610 without penetrating through the substrate 610 and with non-uniform lengths. In FIG. 19C, the dielectric lens area 656 includes dielectric lenses 650A extending downwards from the upper side of the substrate 610 without penetrating through the substrate 610 and with non-uniform lengths and includes dielectric lenses 650B extending upwards from the lower side of the substrate 610 without penetrating through the substrate 610 and with non-uniform lengths. The dielectric lens area 610R1 in accordance of variant embodiments shown in FIG. 19A to FIG. 19C (i.e. the dielectric lens areas 652, 654, 656) may determine particular electromagnetic wave reflective angles and directions and may therefore be applied to various usage requirements.

Figure 20:
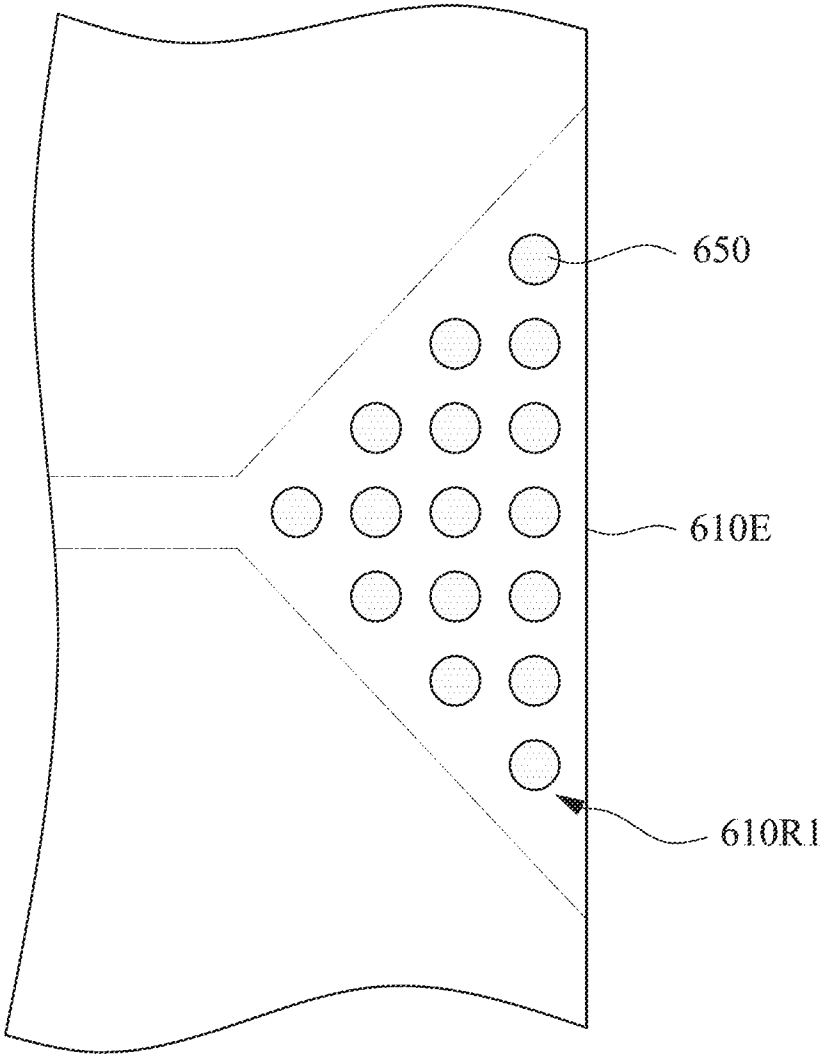
FIG. 20 is a top view of the dielectric lens area in FIG. 17.

FIG. 20 is a top view of the dielectric lens area 610R1 in FIG. 17. As shown in FIG. 20, the dielectric lenses 650 are equally distributed in the dielectric lens area 610R1. In another embodiment, the dielectric lenses 650 may be irregularly disposed in the dielectric lens area 610R1 and may be correspondingly changed according to the arrangement of the dual-polarized antenna unit 620.

Figure 21:
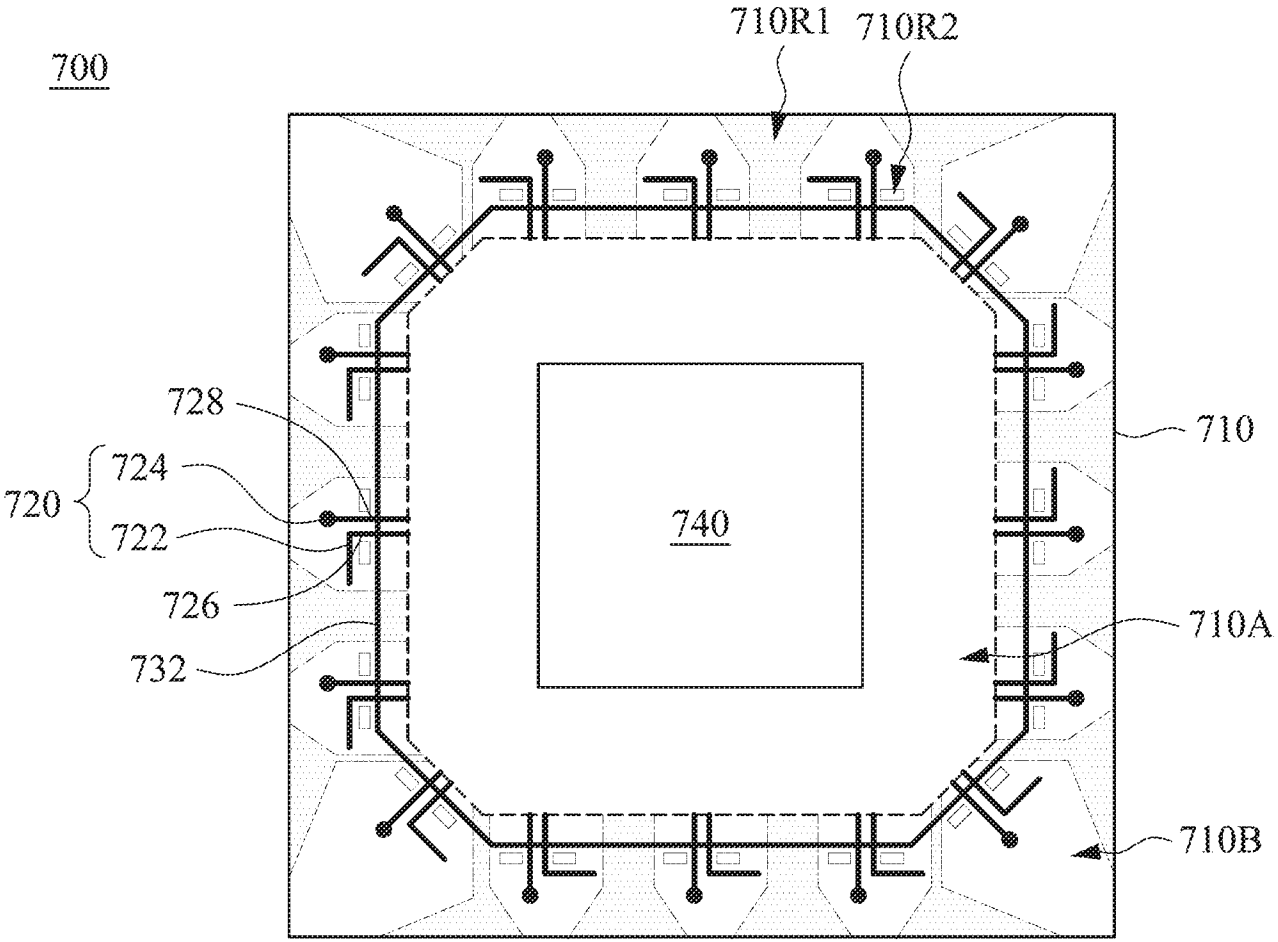
FIG. 21 is a schematic arrangement diagram of an integrated antenna structure in accordance with some embodiments of the invention.

FIG. 21 is a schematic arrangement diagram of an integrated antenna structure 700 in accordance with some embodiments of the invention. The integrated antenna structure 700 includes a substrate 710, dual-polarized antenna units 720, a reflective wall 732 and a chip 740. As shown in FIG. 21, the arrangements of the dual-polarized antenna units 720, the reflective wall 732 and the chip 740 in the substrate 710 are similar to the arrangements of the dual-polarized antenna units 620, the reflective wall 632 and the chip 640 in the substrate 610 shown in FIG. 17. The substrate 710 may be a multi-layered structure, which has a structure of alternately stacked dielectric layers and metal layers as illustrated in FIG. 2. The peripheral area 710B of the substrate 710 has dielectric lens areas 710R1 and 710R2. Each of the dielectric lens areas 710R1 is located between corresponding to two neighboring dual-polarized antenna units 720, and each of the dielectric lens areas 710R2 is located between the corresponding dual-polarized antenna unit 720 and the reflective wall 732. The dual-polarized antenna units 720 include horizontally polarized antennas 722 and vertically polarized antennas 724. The horizontally polarized antennas 722 are configured to generate horizontally polarized beams, and the vertically polarized antennas 724 are configured to generate vertically polarized beams. The horizontally polarized antennas 722 and the vertically polarized antennas 724 are electrically coupled to the components in the center area 710A of the substrate 710 respectively through feeding traces 726, 728. The chip 740 has an RFIC and/or other active and/or passive components for constituting a transmitting and/or receiving circuit. The components in the chip 740 and in and/or on the substrate 710 may be electrically connected with each other through the bonding pads on a side surface of the substrate 710.

Figure 22:
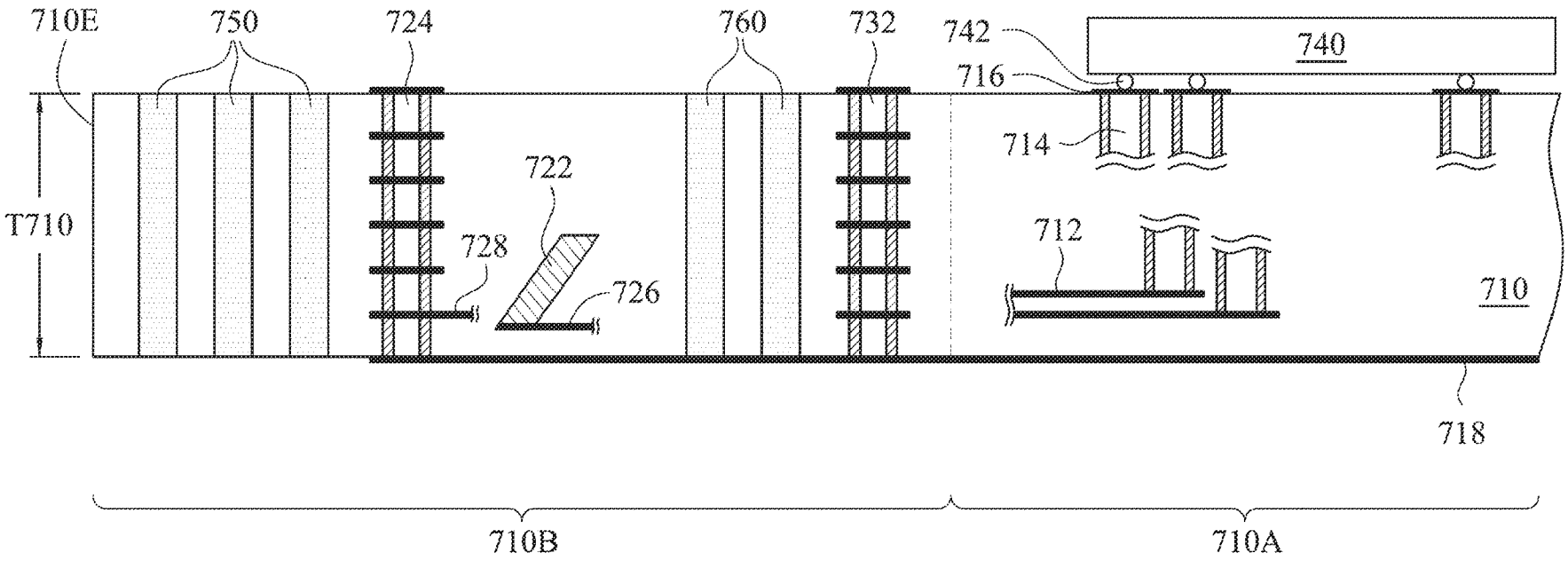
FIG. 22 is a partial structural diagram of the integrated antenna structure in FIG. 21.

FIG. 22 is a partial structural diagram of the integrated antenna structure 700 in FIG. 21. In the partial structural diagram shown in FIG. 22, a dual-polarized antenna unit 720 (which includes a horizontally polarized antenna 722 and a vertically polarized antenna 724) is disposed in the peripheral area 710B of the substrate 710, the reflective wall 732 is disposed between dielectric lenses 750 and the center area 710A of the substrate 710, and the chip 740 is disposed on the substrate 710 and in the center area 710A of the substrate 710. In the peripheral area 710B of the substrate 710, the dielectric lenses 750 are disposed between the side edge 710E of the substrate 710 and the vertically polarized antenna 724, and the dielectric lenses 760 are disposed between the horizontally polarized antenna 722 and the reflective wall 732.

As shown in FIG. 22, the horizontally polarized antenna 722 is a monopole antenna. The horizontally polarized antenna 722 is a monopole arm electrically coupled to the feeding trace 726. The feeding trace 726 may penetrate through the reflective wall 732 and the disposed area of the dielectric lenses 760 to electrically couple to the components in the center area 710A, such that the horizontally polarized antenna 722 is electrically connected to the conductive lines 712, the conductive via structures 714 and/or the other components in the center area 710A. The vertically polarized antenna 724 is a conductive via structure electrically coupled to the feeding trace 728. The feeding trace 728 may penetrate through the reflective wall 732 and the disposed area of the dielectric lenses 760 to electrically couple to the components in the center area 710A, such that the vertically polarized antenna 724 is electrically connected to the conductive lines 712, the conductive via structures 714 and/or the other components in the center area 710A. The dual-polarized antenna unit 720 is between the side edge 710E of the substrate 710 and the reflective wall 732, in which the vertically polarized antenna 724 is nearer to the side edge 710E of the substrate 710 than the horizontally polarized antenna 722. In another embodiment, the horizontally polarized antenna 722 is nearer to the side edge 710E of the substrate 710 than the vertically polarized antenna 724, or alternatively the distance between the horizontally polarized antenna 722 and the side edge 710E of the substrate 710 is approximately the distance between the vertically polarized antenna 724 and the side edge 710E of the substrate 710. or alternatively the distance between the horizontally polarized antenna 722 and the side edge 710E of the substrate 710.

The chip 740 has metal bumps 742 toward a side surface of the substrate. By bonding the metal bumps 742 to the bonding pads 716 on the substrate 710, the chip 740 can be mounted on the substrate 710 to have the components in the chip 740 and the conductive lines 712, the conductive via structure 714 and/or the other components in the substrate 710 electrically connected with each other. The ground plane 718 is disposed on a side of the substrate 710 far away from the chip 740. With the mirroring effect provided by the ground plane 718, the horizontally polarized antenna 722 and/or the vertically polarized antenna 724 may generate similar current distribution and radiation pattern as those of a dipole antenna.

Academically, the length of the horizontally polarized antenna 722 in the horizontally polarized direction and the length of the vertically polarized antenna 724 in the vertically polarized direction may be approximately a quarter of the equivalent wavelength of the electromagnetic wave in the substrate 710. The lengths of the horizontally polarized antenna 722 and the vertically polarized antenna 724 may be designed by referencing the aforementioned description regarding the horizontally polarized antenna 322 and the vertically polarized antenna 324 of the integrated antenna structure 300 and thus is note described again herein. The horizontally polarized antenna 722 and the vertically polarized antenna 724 may have the same resonant frequency or alternatively have different resonant frequencies. In addition, the thickness $T_{710}$ of the substrate 710 may be equal to or greater than the length of the vertically polarized antenna 724 in the vertically polarized direction.

The dielectric lenses 750 are used to change the horizontally polarized beam generated by the horizontally polarized antenna 722 and the vertically polarized beam generated by the vertically polarized antenna 724, such that the strength distributions of the horizontally polarized beam and the vertically polarized beam may be more concentrated, that is, the directivities of the horizontally polarized beam and the vertically polarized beam are enhanced. In addition, the dielectric lenses 750 are in the dielectric lens area 710R1 shown in FIG. 21.

The dielectric lenses 760 are used to change the horizontally polarized beam generated by the horizontally polarized antenna 722 and the vertically polarized beam generated by the vertically polarized antenna 724 and to block radiation waves from interfering the components in the center area. In addition, the dielectric lenses 760 are in the dielectric lens area 710R2 shown in FIG. 21. In another embodiment, the integrated antenna structure 700 may include only the dielectric lenses 760 and may not include the reflective wall 732.

The components in the integrated antenna structure 700 other than the substrate 710, the ground plane 718, the horizontally polarized antennas 722, the vertically polarized antennas 724 and the feeding traces 726, 728 may be similar to those in the integrated antenna structure 600 in FIG. 17 and FIG. 18, and therefore the related description can be referred to the foregoing paragraphs and is not repeated herein.

Figure 23:
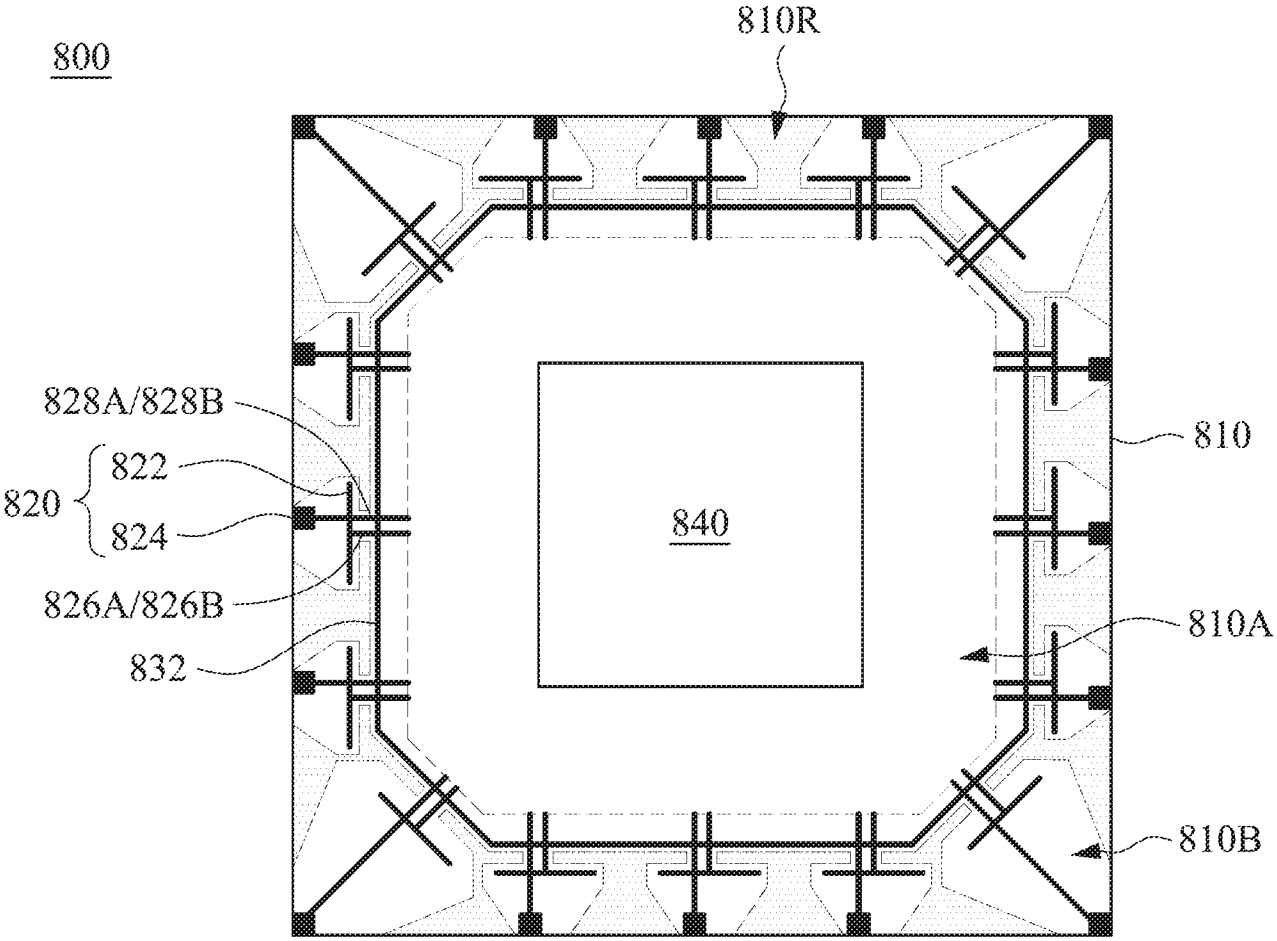
FIG. 23 is a schematic arrangement diagram of an integrated antenna structure in accordance with some embodiments of the invention.

FIG. 23 is a schematic arrangement diagram of an integrated antenna structure 800 in accordance with some embodiments of the invention. The integrated antenna structure 80 includes ae substrate 810, dual-polarized antenna units 820, a reflective wall 832 and a chip 840. As shown in FIG. 23, the arrangements of the reflective wall 832 and the chip 840 in the substrate 810 are similar to the arrangements of the reflective wall 632 and the chip 640 in the substrate 610 shown in FIG. 17. The substrate 810 may be a multi-layered structure, which has a structure of alternately stacked dielectric layers and metal layers as illustrated in FIG. 2. The dual-polarized antenna units 820 include horizontally polarized antennas 822 and vertically polarized antennas 824. The horizontally polarized antennas 822 are configured to generate horizontally polarized beams, and the vertically polarized antennas 824 are configured to generate vertically polarized beams. The horizontally polarized antennas 822 and the vertically polarized antennas 824 are electrically coupled to the components in the center area 810A of the substrate 810 respectively through the feeding traces 826A, 826B, 828A, 828B. The chip 840 has an RFIC and/or other active and/or passive components for constituting a transmitting and/or receiving circuit. The components in the chip 840 and in and/or on the substrate 810 may be electrically connected with each other through the bonding pads on a side surface of the substrate 810.

Figure 24:
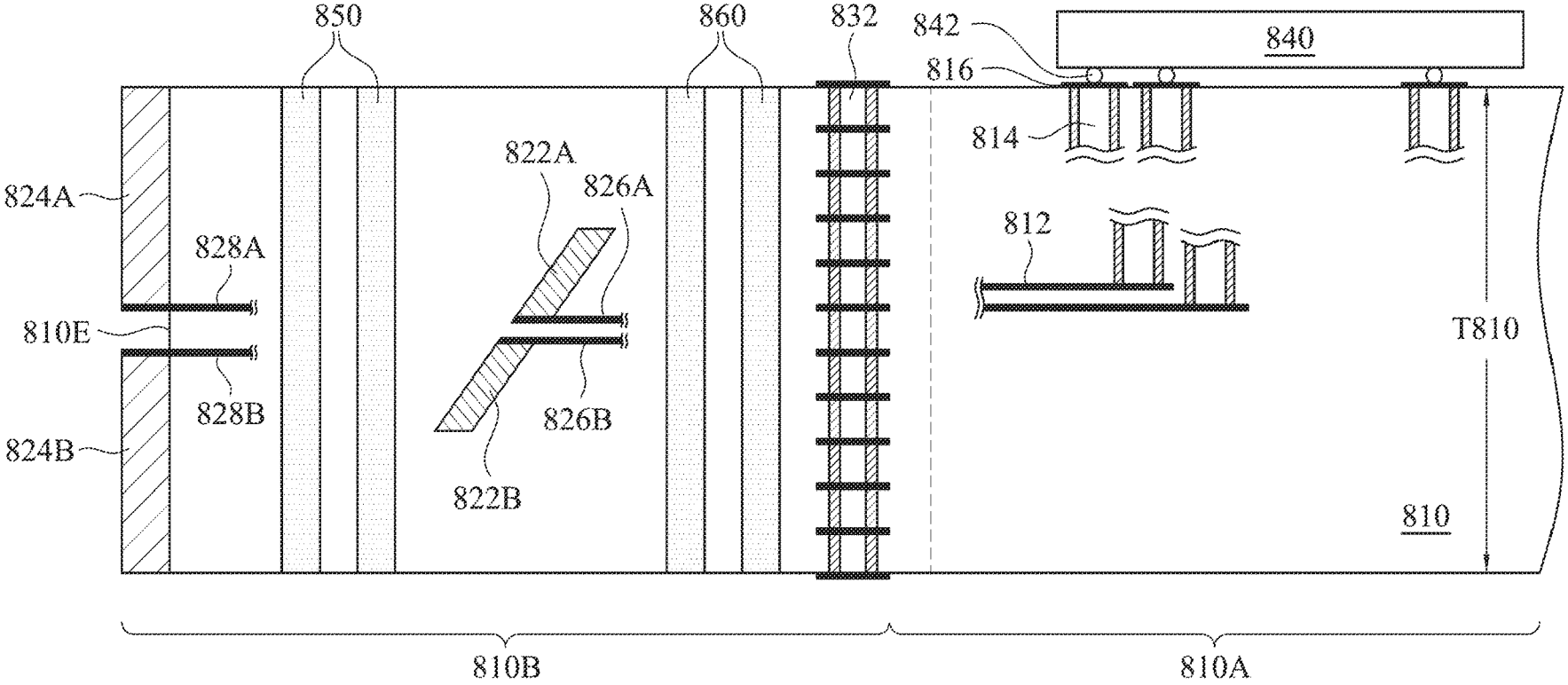
FIG. 24 is a partial structural diagram of the integrated antenna structure in FIG. 23.

FIG. 24 is a partial structural diagram of the integrated antenna structure 800 FIG. 23. In the partial structural diagram shown in FIG. 24, a dual-polarized antenna unit 820 (which includes a horizontally polarized antenna 822 and a vertically polarized antenna 824) is disposed in the peripheral area 810B of the substrate 810, in which the vertically polarized antenna 824 is on the side edge 810E of the substrate 810, and the horizontally polarized antenna 822 is between dielectric lenses 850 and the dielectric lenses 860. The reflective wall 832 is disposed between the dielectric lenses 860 and the center area 810A of the substrate 810, and the chip 840 is disposed on the substrate 810 and in the center area 810A of the substrate 810. In the peripheral area 810B of the substrate 810, the dielectric lenses 850 are disposed between the side edge 810E of the substrate 810 and the horizontally polarized antenna 822, and the dielectric lenses 860 are disposed between the horizontally polarized antenna 822 and the reflective wall 832.

As shown in FIG. 24, the horizontally polarized antenna 822 and the vertically polarized antenna 824 are all microstrip dipole antennas. The horizontally polarized antenna 822 includes two dipole arm 822A, 822B respectively electrically coupled to the feeding traces 826A, 826B. The vertically polarized antenna 824 includes two dipole arms 824A, 824B respectively electrically coupled to the feeding traces 828A, 828B. The feeding traces 826A, 826B may penetrate through the reflective wall 832 and the disposed area of the dielectric lenses 860 to respectively electrically couple to the components in the center area 810A, and the feeding traces 828A, 828B may penetrate through the reflective wall 832 and the disposed area of the dielectric lenses 850, 860 to respectively electrically couple to the components in the center area 810A, such that the dipole arms 822A, 822B, 824A, 824B are respectively electrically connected to the conductive lines 812, the conductive via structures 814 and/or the other components in the center area 810A.

The resonant frequencies of the horizontally polarized antenna 822 and the vertically polarized antenna 824 are dependent from the lengths of the dipole arms 822A, 822B, 824A, 824B. The lengths of the dipole arms 822A, 822B, 824A, 824B may be designed by referencing the aforementioned description regarding the dipole arms 422A, 422B, 424A, 424B of the integrated antenna structure 400 and thus is not described again herein. The horizontally polarized antenna 822 and the vertically polarized antenna 824 may have the same resonant frequency or alternatively have different resonant frequencies. In addition, the thickness $T_{810}$ of the substrate 810 may be equal to or greater than the length of the vertically polarized antenna 824 in the vertically polarized direction.

The chip 840 has metal bumps 842 toward a side surface of the substrate. By bonding the metal bumps 842 to the bonding pads 816 on the substrate 810, the chip 840 can be mounted on the substrate 810 to have the components in the chip 840 and the conductive lines 812, the conductive via structure 814 and/or the other components in the substrate 810 electrically connected with each other.

The dielectric lenses 850 are used to change the horizontally polarized beam generated by the horizontally polarized antenna 822 and the vertically polarized beam generated by the vertically polarized antenna 824, such that the strength distributions of the horizontally polarized beam and the vertically polarized beam may be more concentrated, that is, the directivities of the horizontally polarized beam and the vertically polarized beam are enhanced. The dielectric lenses 860 are used to change the horizontally polarized beam generated by the horizontally polarized antenna 822 and the vertically polarized beam generated by the vertically polarized antenna 824 and to block radiation waves from interfering the components in the center area 810A. In addition, as shown in FIG. 23, the dielectric lenses 850, 860 are in the dielectric lens area 810R. In another embodiment, the integrated antenna structure 800 may include only the dielectric lenses 850, 860 and may not include the reflective wall 832.

The components in the integrated antenna structure 800 other than the horizontally polarized antennas 822, the vertically polarized antennas 824, the feeding traces 828A, 828B and the dielectric lenses 850 may be respectively similar to the integrated antenna structure 600 in FIG. 17 and FIG. 18, and therefore the related description can be referred to the foregoing paragraphs and is not repeated herein.

Figure 25:
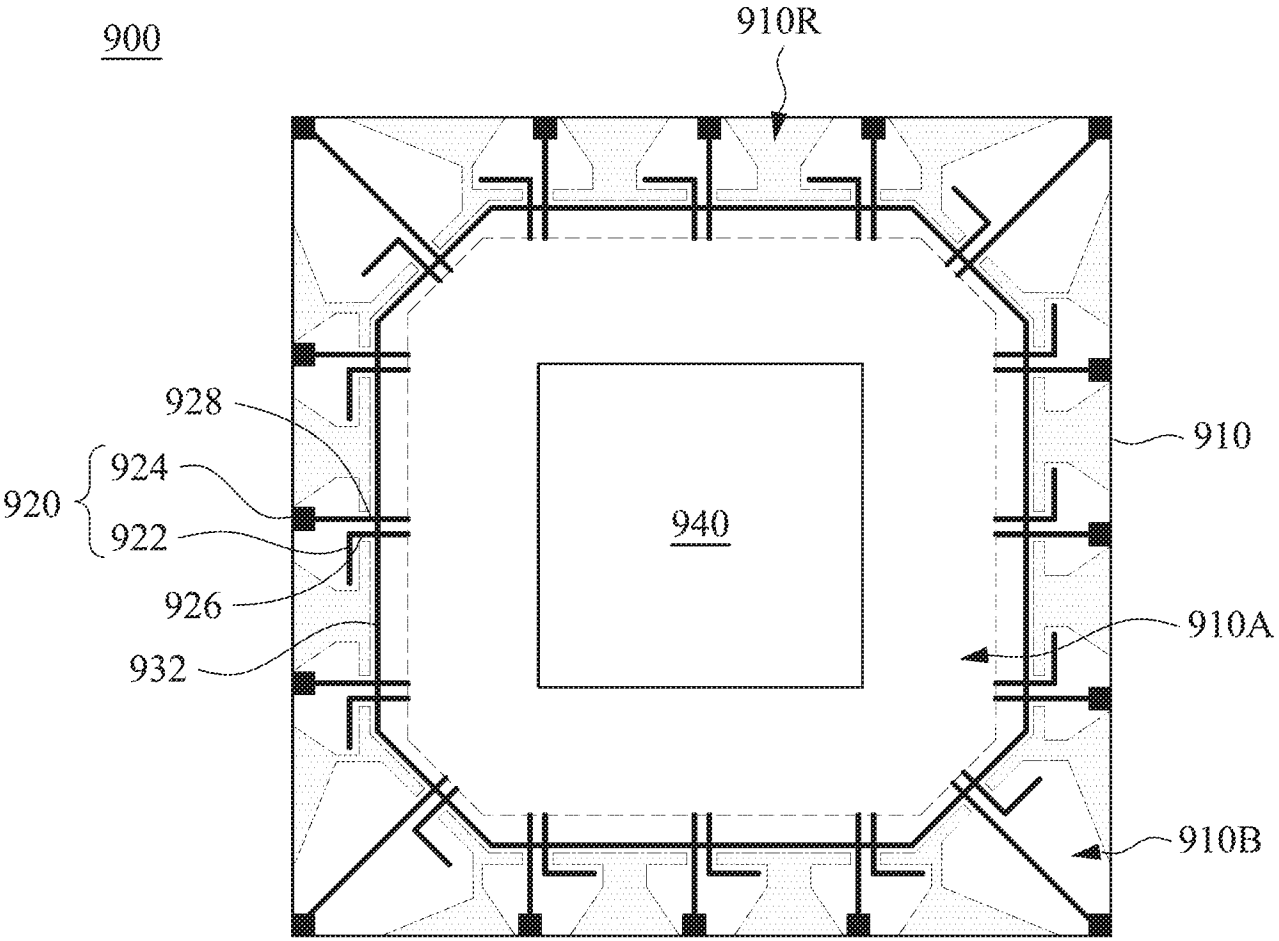
FIG. 25 is a schematic arrangement diagram of an integrated antenna structure in accordance with some embodiments of the invention.

FIG. 25 is a schematic arrangement diagram of an integrated antenna structure 900 in accordance with some embodiments of the invention. The integrated antenna structure 900 includes a substrate 910, dual-polarized antenna units 920, a reflective wall 932 and a chip 940. As shown in FIG. 25, the arrangements of the dual-polarized antenna units 920, the reflective structure 930 and the chip 940 in the substrate 910 are similar to the arrangements of the dual-polarized antenna units 820, the reflective wall 832 and the chip 840 in the substrate 810 shown in FIG. 23. The substrate 910 may be a multi-layered structure, which has a structure of alternately stacked dielectric layers and metal layers as illustrated in FIG. 2. The dual-polarized antenna units 920 include horizontally polarized antennas 922 and vertically polarized antennas 924. The horizontally polarized antennas 922 are configured to generate horizontally polarized beams, and the vertically polarized antennas 924 are configured to generate vertically polarized beams. The horizontally polarized antennas 922 and the vertically polarized antennas 924 are electrically coupled to the components in the center area 910A of the substrate 910 respectively through the feeding traces 926, 928. The chip 940 has an RFIC and/or other active and/or passive components for constituting a transmitting and/or receiving circuit. The components in the chip 940 and in and/or on the substrate 910 may be electrically connected with each other through the bonding pads on a side surface of the substrate 910.

Figure 26:
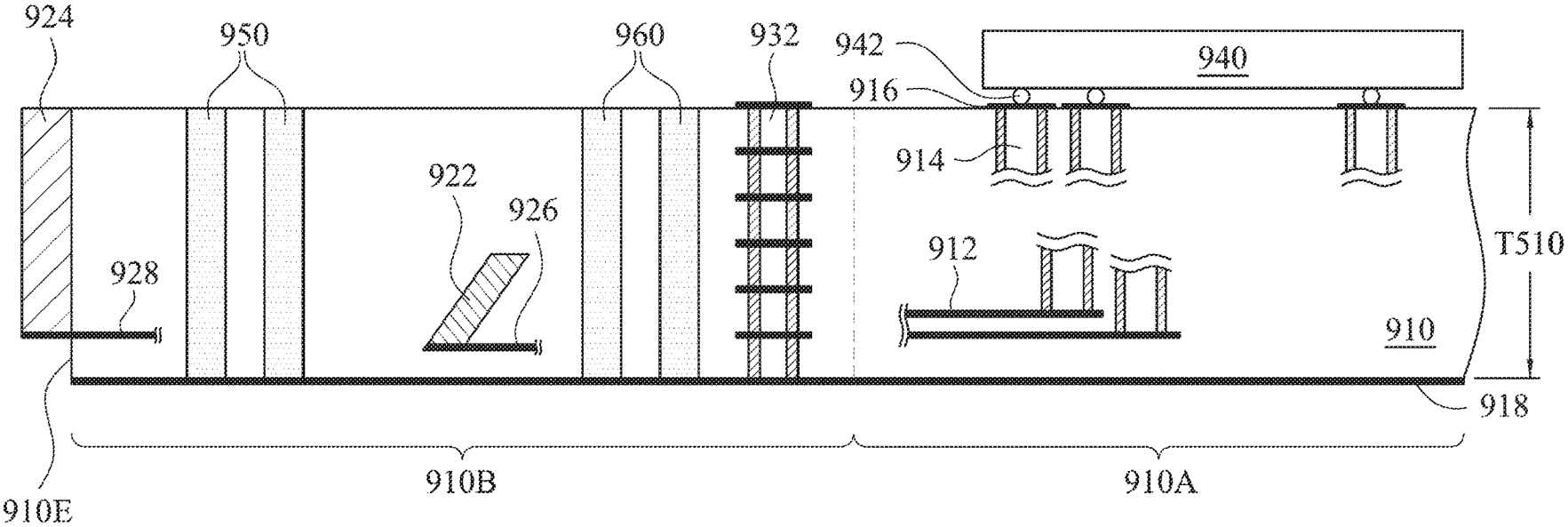
FIG. 26 is a partial structural diagram of the integrated antenna structure in FIG. 25.

FIG. 26 is a partial structural diagram of the integrated antenna structure 900 in FIG. 25. In the partial structural diagram shown in FIG. 26, a dual-polarized antenna unit 920 (which includes a horizontally polarized antenna 922 and a vertically polarized antenna 924) is disposed in the peripheral area 910B of the substrate 910, in which the vertically polarized antenna 924 is on the side edge 910E of the substrate 910, and the horizontally polarized antenna 922 is between dielectric lenses 950 and the dielectric lenses 960. The reflective wall 932 is disposed between the dielectric lenses 960 and the center area 910A of the substrate 910, and the chip 940 is disposed on the substrate 910 and in the center area 910A of the substrate 910. In the peripheral area 910B of the substrate 910, the dielectric lenses 950 are disposed between the side edge 910E of the substrate 910 and the horizontally polarized antenna 922, and the dielectric lenses 960 is disposed between the horizontally polarized antenna 922 and the reflective wall 932.

As shown in FIG. 26, the horizontally polarized antenna 922 and the vertically polarized antenna 924 are all microstrip monopole antennas respectively electrically coupled to the feeding traces 926, 928. The feeding trace 926 may penetrate through the reflective wall 932 and the disposed area of the dielectric lenses 960 to couple to the components in the center area 910A, and the feeding trace 928 may penetrate through the reflective wall 932 and the disposed areas of dielectric lenses 950, 960 to electrically couple to the components in the center area 910A, such that the horizontally polarized antenna 922 and the vertically polarized antenna 924 are respectively electrically to the conductive lines 912, the conductive via structure 914 and/or other components the center area 910A.

The chip 940 has metal bumps 942 toward a side surface of the substrate. By bonding the metal bumps 942 to the bonding pads 916 on the substrate 910, the chip 940 can be mounted on the substrate 910 to have the components in the chip 940 and the conductive lines 912, the conductive via structures 914 and/or the other components in the substrate 910 electrically connected with each other. The ground plane 918 is disposed on a side of the substrate 910 far away from the chip 940. With the mirroring effect provided by the ground plane 918, the horizontally polarized antenna 922 and/or the vertically polarized antenna 924 may generate similar current distribution and radiation pattern as those of a dipole antenna.

Academically, the length of the horizontally polarized antenna 922 in the horizontally polarized direction and the length of the vertically polarized antenna 924 in the vertically polarized direction may be approximately a quarter of the equivalent wavelength of the electromagnetic wave in the substrate 910. The lengths of the horizontally polarized antenna 922 and the vertically polarized antenna 924 may be designed according to the aforementioned description regarding the horizontally polarized antenna 522 and the vertically polarized antenna 524 of the integrated antenna structure 500 and thus is not described again herein. The horizontally polarized antenna 922 and the vertically polarized antenna 924 may have the same resonant frequency or alternative have different resonant frequencies. In addition, the thickness T910 of the substrate 910 may be equal to or greater than the length of the vertically polarized antenna 924 in the vertically polarized direction.

The dielectric lenses 950 are used to change the horizontally polarized beam generated by the horizontally polarized antenna 922 and the vertically polarized beam generated by the vertically polarized antenna 924, such that the strength distributions of the horizontally polarized beam and the vertically polarized beam may be more concentrated, that is, the directivities of the horizontally polarized beam and the vertically polarized beam are enhanced. The dielectric lenses 960 are used to change the horizontally polarized beam generated by the horizontally polarized antenna 922 and the vertically polarized beam generated by the vertically polarized antenna 924 and to block radiation waves from interfering the components in the center area 910A. In addition, the dielectric lenses 950, 960 are in the dielectric lens area 910R shown in FIG. 23. In another embodiment, the integrated antenna structure 900 may include only the dielectric lenses 950, 960 and may not include the reflective wall 932.

The components in the integrated antenna structure 900 other than the horizontally polarized antennas 922, the vertically polarized antennas 924, the feeding traces 928 and the dielectric lenses 950 may be respectively similar to the integrated antenna structure 700 in FIG. 21 and FIG. 22. In addition, the other components in the integrated antenna structure 900 may be respectively similar to the integrated antenna structure 800 in FIG. 23 and FIG. 24, and therefore the related description can be referred to the foregoing paragraphs and is not repeated herein.

Figure 27:
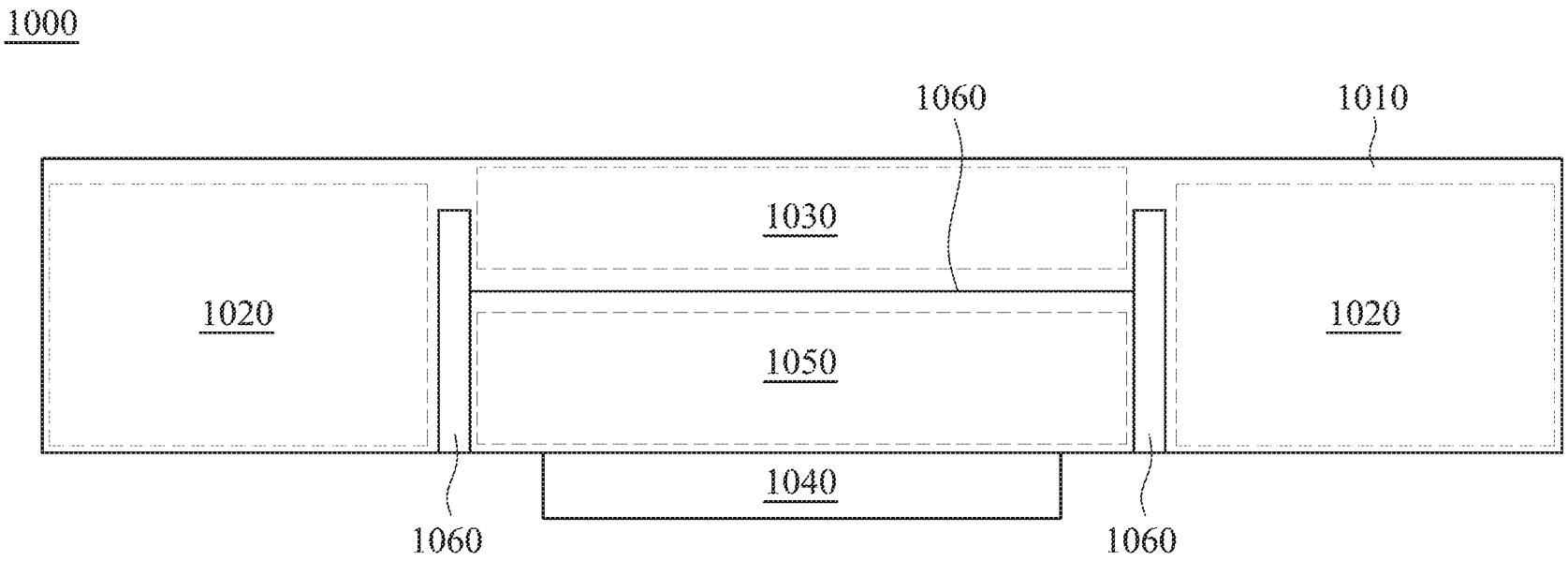
FIG. 27 is a schematic arrangement diagram of the integrated antenna structure 1000 in accordance with some embodiments of the invention.

FIG. 27 is a schematic arrangement diagram of the integrated antenna structure 1000 in accordance with some embodiments of the invention. The integrated antenna structure 1000 includes a substrate 1010, dual-polarized antenna units 1020, a broadband antenna unit 1030, a chip 1040, conductive components 1050 and a reflective structure 1060. The substrate 1010, the dual-polarized antenna units 1020, the chip 1040, the conductive components 1050 and the reflective structure 1060 may respectively correspond to the substrate, the dual-polarized antenna units, the chip, the conductive lines, the conductive via structures and the reflective structure/reflective wall of the foregoing embodiments. The broadband antenna unit 1030 may be formed of phased array antennas disposed on a side of the substrate 1010 far away from the chip 1040 and used to generate a multi-beam array with angles with respect to the planar direction of the substrate 1010, and the reflective structure 1060 is between the broadband antenna unit 1030 and the chip 1040. The broadband antenna unit 1030 may be electrically connected to the conductive components 1050 by the feeding traces penetrating through the reflective structure 1060.

Figure 28B:
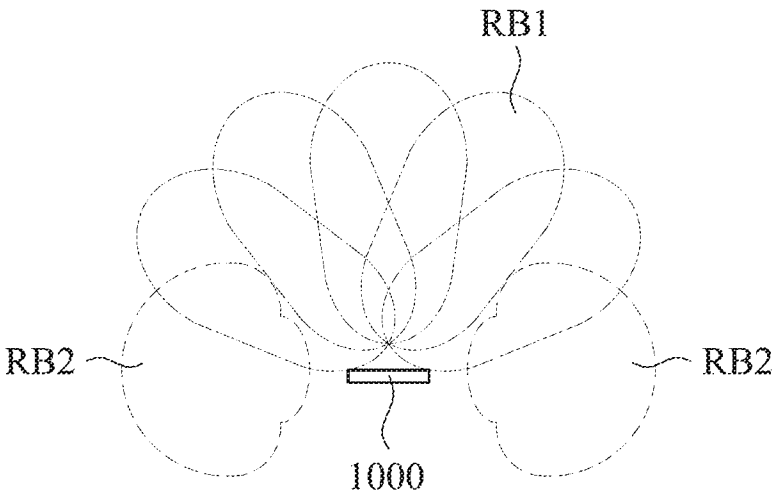
FIG. 28A and FIG. 28B are respectively a top view and a side view of the beams generated by the integrated antenna structure in FIG. 27.
Figure 28A:
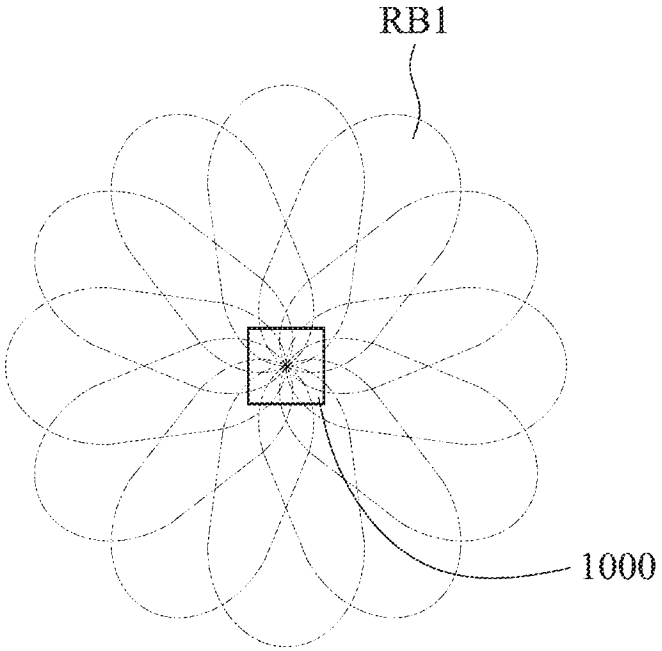

FIG. 28A and FIG. 28B are respectively a top view and a side view of the beams generated by the integrated antenna structure 1000 in FIG. 27. As shown in FIG. 28A and FIG. 28B, in addition to the normal beams RB1 generated on the top surface of the integrated antenna structure 1000, the side omnidirectional dual-polarized beams RB2 are also generated on the side surface of the integrated antenna structure 1000. In addition, in embodiments of the invention, the arrangement of the dielectric lenses may increase such as antenna gains and beam directivities.

Although the invention is described above by means of the implementation manners, the above description is not intended to limit the invention. A person of ordinary skill in the art can make various variations and modifications without departing from the spirit and scope of the invention, and therefore, the protection scope of the invention is as defined in the appended claims.

What is claimed is:

1. An integrated antenna structure, comprising:
a multilayer substrate having dielectric layers and metal layers that are alternately stacked;
a dual-polarized antenna unit disposed in the multilayer substrate and at a side edge portion of the multilayer substrate, the dual-polarized antenna unit comprising a horizontally polarized antenna and a vertically polarized antenna; and
a dielectric lens disposed in the multilayer substrate and at the side edge portion of the multilayer substrate, the dielectric lens formed of at least one non-conductive via structure.

2. The integrated antenna structure of claim 1, wherein the horizontally polarized antenna is a monopole antenna.

3. The integrated antenna structure of claim 1, wherein the vertically polarized antenna is a monopole antenna.

4. The integrated antenna structure of claim 1, wherein the horizontally polarized antenna is a dipole antenna.

5. The integrated antenna structure of claim 1, wherein the vertically polarized antenna is a dipole antenna.

6. The integrated antenna structure of claim 1, wherein the vertically polarized antenna is formed of at least one conductive via structure.

7. The integrated antenna structure of claim 1, wherein the dual-polarized antenna unit is electrically coupled to at least one feeding trace that is electrically connected to components in a center area of the multilayer substrate.

8. The integrated antenna structure of claim 1, further comprising:
a broadband antenna unit disposed in a center area of the multilayer substrate.

9. The integrated antenna structure of claim 1, wherein the dielectric lens is disposed laterally between the horizontally polarized antenna and the vertically polarized antenna.

10. The integrated antenna structure of claim 1, wherein the dielectric lens is laterally closer to a side edge of the multilayer substrate than the dual-polarized antenna unit.

11. The integrated antenna structure of claim 1, further comprising:
a radio frequency (RF) chip disposed in a center area of the multilayer substrate; and
a reflective structure disposed laterally between the RF chip and the dual-polarized antenna unit, the reflective structure formed of at least one conductive via structure.

12. The integrated antenna structure of claim 1, wherein each of the at least one non-conductive via structure is perpendicular to a planar direction of the multilayer substrate and penetrates through at least one of the dielectric layers and at least one of the metal layers.

13. The integrated antenna structure of claim 1, wherein each of the least one non-conductive via structure comprises:
a via hole formed in the multilayer substrate; and
a dielectric material filled in the via hole.

14. The integrated antenna structure of claim 1, wherein each of the least one non-conductive via structure is a via hole filled with air.

15. An integrated antenna structure, comprising:
a multilayer substrate having dielectric layers and metal layers that are alternately stacked;
a plurality of antenna units disposed in the multilayer substrate and at at least one side edge portion of the multilayer substrate, the antenna units spaced from each other, and each of the antenna units comprising a horizontally polarized antenna and a vertically polarized antenna; and
a plurality of dielectric lenses disposed in the multilayer substrate and at the at least one side edge portion of the multilayer substrate, the dielectric lenses and the antenna units alternately disposed along the at least one side edge portion of the multilayer substrate, and the dielectric lenses formed of a plurality of non-conductive via structures.

16. The integrated antenna structure of claim 15, wherein the antenna units and the dielectric lenses laterally surround a center area of the multilayer substrate.

17. An integrated antenna structure, comprising:
a multilayer substrate having dielectric layers and metal layers that are alternately stacked;
a first antenna unit disposed within a center area of the multilayer substrate;
a plurality of second antenna units disposed in the multilayer substrate and at at least one side edge portion of the multilayer substrate, the second antenna units spaced from each other and laterally surrounding the first antenna unit; and
a plurality of dielectric lenses disposed in the multilayer substrate and at the at least one side edge portion of the multilayer substrate, the dielectric lenses and the second antenna units alternately disposed along the at least one side edge portion of the multilayer substrate, and the dielectric lenses formed of a plurality of non-conductive via structures.

18. The integrated antenna structure of claim 17, further comprising:
a radio frequency (RF) chip disposed within the center area of the multilayer substrate and opposite to the first antenna unit; and
a reflective structure disposed laterally between the RF chip and the second antenna units, the reflective structure formed of at least one conductive via structure.

19. The integrated antenna structure of claim 17, wherein the first antenna unit is a phased array antenna.

20. The integrated antenna structure of claim 17, wherein each the second antenna units comprises a horizontally polarized antenna and a vertically polarized antenna.

* * * * *